US005624264A

United States Patent [19]

Houlberg

[11] Patent Number: 5,624,264

[45] Date of Patent: Apr. 29, 1997

[54] MISSILE LAUNCH SIMULATOR

[75] Inventor: Christian L. Houlberg, Ventura, Calif.

[73] Assignee: The United States of America as Represented by the Secretary of the Navy, Washington, D.C.

[21] Appl. No.: 536,309

[22] Filed: Sep. 29, 1995

[51] Int. Cl.[6] ..... F41A 33/00

[52] U.S. Cl. ..... 434/12; 434/11; 434/14; 324/73.1; 89/41.01

[58] Field of Search ..... 434/11–15, 379; 273/317; 364/423, 578, 461; 89/41.01; 455/39, 73; 324/73.1, 158.1; 463/49

[56] References Cited

U.S. PATENT DOCUMENTS

| | | | |
|---|---|---|---|
| 2,971,274 | 2/1961 | Thornton | 424/12 |
| 3,701,206 | 10/1972 | Ormiston | 434/12 |
| 4,232,456 | 11/1980 | Harmon et al. | 434/12 |
| 4,326,847 | 4/1982 | Roe . | |
| 4,552,533 | 11/1985 | Walmsley . | |
| 4,681,017 | 7/1987 | Fischer et al. | 434/12 X |
| 4,825,151 | 4/1989 | Aspelin | 324/73.1 |
| 5,228,854 | 7/1993 | Eldridge | 434/27 X |
| 5,325,302 | 6/1994 | Izidon et al. | 364/461 |
| 5,414,347 | 5/1995 | Monk et al. . | |

*Primary Examiner*—Joe Cheng

*Attorney, Agent, or Firm*—David S. Kalmbaugh; Melvin J. Sliwka

[57] ABSTRACT

A missile launch simulator for testing the launch of a missile from a missile launcher on board an aircraft. The missile launch simulator emulates the functions of the missile's on board turbo generator by utilizing microprocessor controlled relays to provide phase A, phase B and phase C gyro drive signals to the missile's gyro when the umbilical cord connecting the missile to the launcher is opened during an emulated launch. The missile launch simulator also provides high voltage power to the missile's on board electronics after an emulated launch by utilizing microprocessor controlled relays and the missile launcher filament power to emulate the turbo generator's high voltage power signal which powers the missile's on board electronics after the missile is launched from the aircraft.

20 Claims, 13 Drawing Sheets

MISSILE LAUNCH SIMULATOR

BACKGROUND OF THE INVENTION

1. Field of the Invention

The present invention relates generally to a launch environment simulator and more specifically to a launch simulating system for simulating the launch of guidance system projectiles, such as a missile, from the launcher aboard an aircraft.

2. Description of the Prior Art

In the past missile's have been test fired from an aircraft while in flight in order to test the missile launch sequence from the aircraft's on board launcher as well as to test the flight of the missile toward its target.

While this method of testing the missile launch sequence from the aircraft's on board launcher is satisfactory in that potential problems during the launch of a missile are uncovered prior to the missile's deployment to its associated aircraft, such as the F/A-18, there are certain problems associated with the "live fire" testing of a missile launch sequence.

For example, once the missile is launched from the aircraft, the missile is either rendered useless because it has been destroyed during the test flight or severely damaged, or a portion of the missile's internal components will have to be replaced even though the missile may have been recovered after the test flight. This becomes very expensive which in the down sizing of Defense Department budgets creates a need for an economical method to test the launch of a missile from an aircraft without the actual firing of the missile.

Accordingly, there is a need for an economical means to test the missile launch sequence from an aircraft without the actual launch of the missile from the aircraft.

SUMMARY OF THE INVENTION

The present invention overcomes the disadvantages of the prior art including those mention above in that it comprises a very economical missile launch simulator for testing the launch of a missile from a missile launcher on board an aircraft without the actual live fire of the missile from the aircraft. The missile launch simulator emulates the functions of the missile's on board turbo generator by utilizing microprocessor controlled relays to provide phase A, phase B and phase C gyro drive signals to the missile's gyro when the umbilical cord connecting the missile to the launcher is opened during launch. The missile launch simulator also provides high voltage power to the missile's on board electronics after launch by utilizing microprocessor controlled relays and the missile launcher filament power to emulate the turbo generator's high voltage power signal which powers the missile's on board electronics after the missile is launched from the aircraft.

Microprocessor controlled relay circuitry is also provided for emulating the acceleration of the missile after the missile is launched from the aircraft and for emulating the coast of the missile after the missile's fuel is spent.

DETAILED DESCRIPTION OF THE PREFERRED EMBODIMENT

Figure 1:
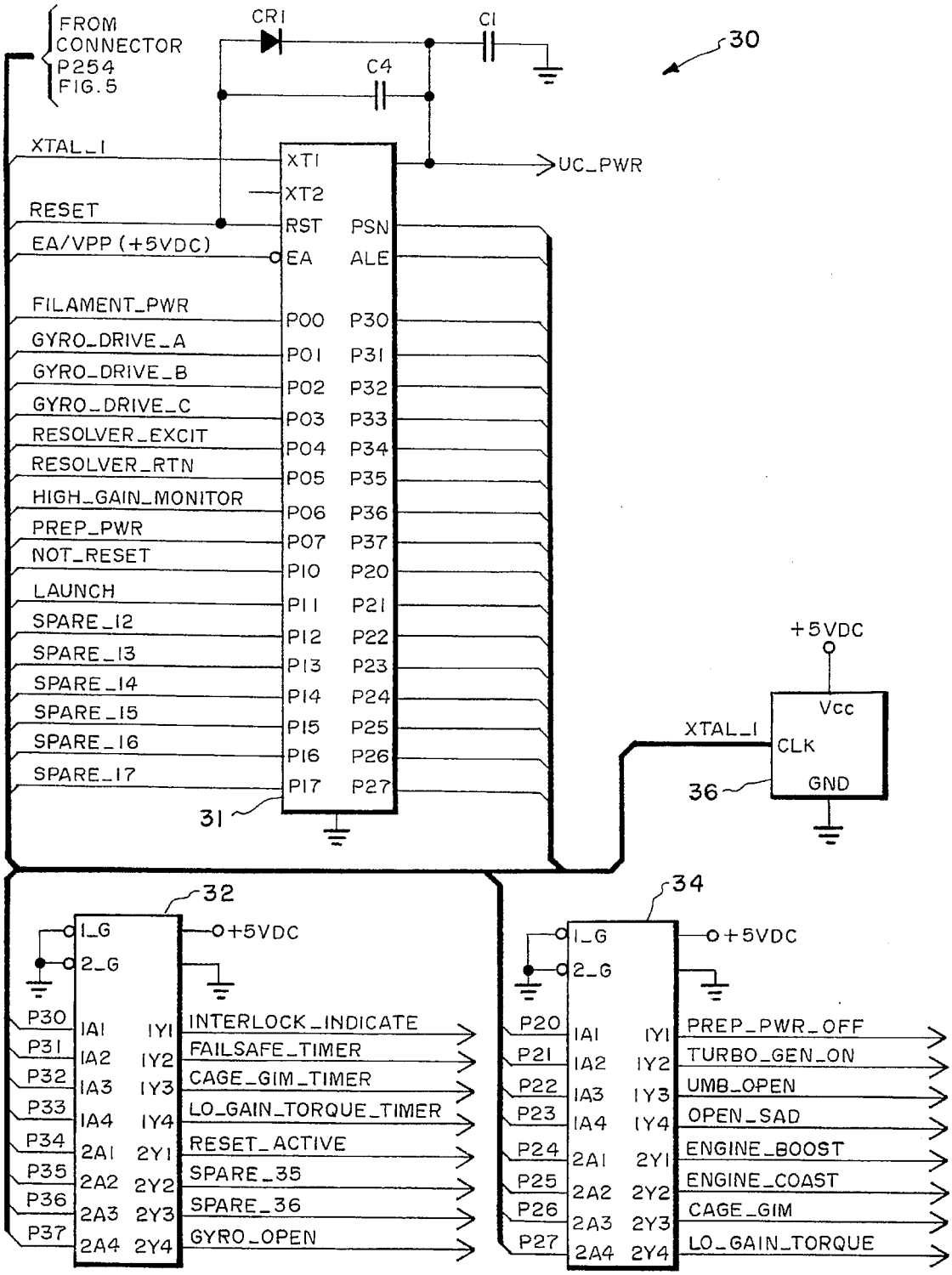
FIG. 1 is a detailed electrical schematic diagram illustrating the control circuitry including the microprocessor and other circuit elements used within the missile launch simulator which constitutes the present invention.
Figure 5:
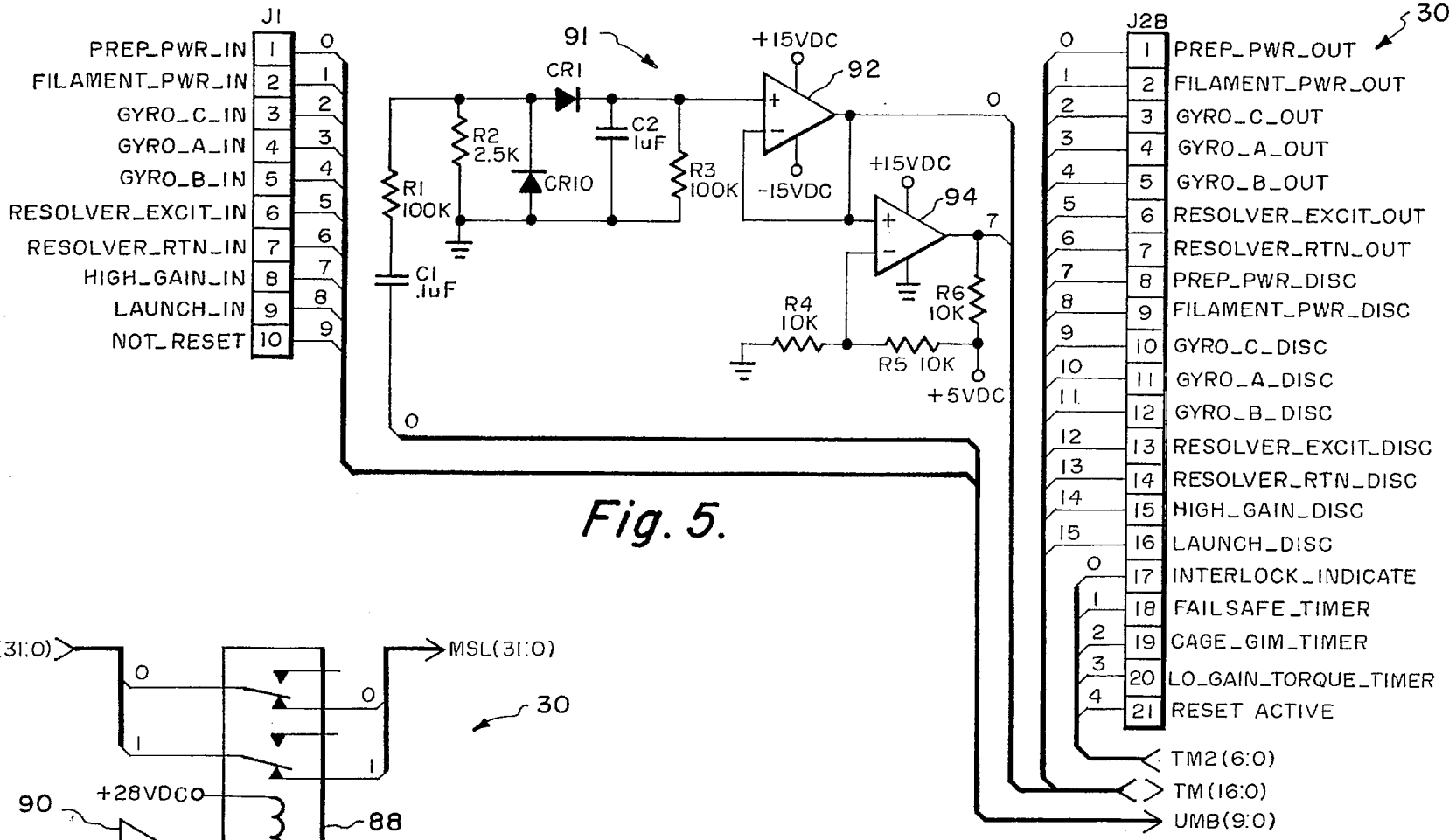
FIG. 5 is a detailed electrical schematic diagram illustrating a portion of the signal conditioning circuitry of the missile launch simulator.
Figure 6:
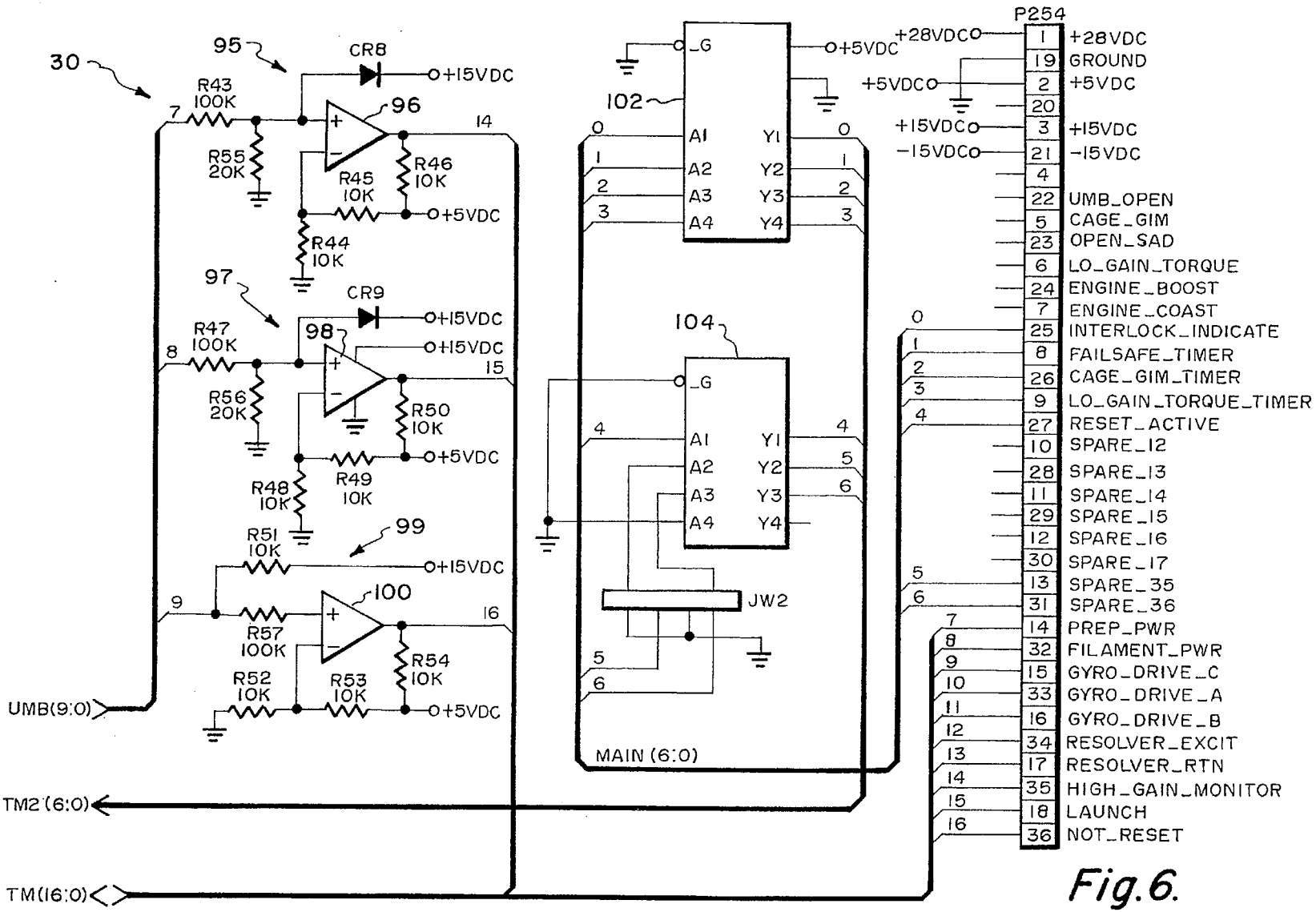
FIG. 6 is a detailed electrical schematic diagram illustrating additional signal conditional circuitry of the missile launch simulator.

Referring first to FIGS. 1, 5 and 6, there is shown the control circuitry for missile launch simulator 30 which includes a microprocessor 31, a system clock signal generator 36 for providing a twelve megahertz system clock signal to the XT1 input of microprocessor 31 and a pair of line drivers 32 and 34 which are respectively connected to output ports P3 and P2 of microprocessor 31.

Launcher generated power and control signals are provided from a missile launcher (not illustrated) attached to the underside of the wing of a fighter aircraft via input terminal J1 to a plurality of signal conditioning circuits 91, 95, 97 and 99 which condition these power and control signals for compatibility with microprocessor 31 and the telemetry unit of a missile.

These launcher generated power and control signals include PREP_PWR_IN, FILIMENT_PWR_IN, GYRO_A_IN, GYRO_B_IN, GYRO_C_IN, RESOLVER_EXCIT_IN and RESOLVER_RTN_IN having a frequency compatible with the aircraft and missile electronics. These launcher generated control signals also include HIGH_GAIN_IN, LAUNCH_IN and NOT_RESET which are discrete signals used for missile and missile launch simulator control.

Prior to launch of a missile, the missile launcher provides power to the missile's on board Klystron via an umbilical cord connecting the missile launcher to the missile. The missile launcher also provides to the missile via the umbilical cord Gyro drive phase A, Gyro drive phase B and Gyro drive phase C signals for the missile's gyro as well as a prep power signal which is the power signal for the missile's on board logic. After the missile is launched from the aircraft a turbo generator on board the missile normally provides Gyro drive phase A, Gyro drive phase B and Gyro drive phase C signals as well as a turbo generator high voltage signal. Missile launch simulator 30 emulates the function of the missile's on board turbo generator by providing the Gyro drive phase A, Gyro drive phase B and Gyro drive phase C signals as well as a high voltage signal once the missile's is launched from the aircraft.

The following discussion illustrates the operation of signal conditioning circuit 91 in conditioning the PREP_PWR_IN signal for compatibility with microprocessor 31 and the telemetry unit of a missile. The signal conditioning circuits for the FILIMENT_PWR_IN, GYRO_A_IN, GYRO_B_IN, GYRO_C_IN, RESOLVER_EXCIT_IN and RESOLVER_RTN_IN signals function in the same manner as signal conditioning circuit 91.

The PREP_PWR_IN signal is first supplied to a capacitor C1 which capacitively couples the signal to eliminate DC voltage from the signal. The PREP_PWR_IN signal is next supplied to a voltage divider circuit consisting of a resistor R1 and a resistor R2 which divides the signal by a factor of about forty. A diode CR10 clamps the PREP_PWR_IN signal so that any negative excursion of the signal does not significantly exceed zero volts. The PREP_PWR_IN signal which is now positive is provided through diode CR1 to a capacitor C2 charging capacitor C2 to the peak positive amplitude voltage of the divided PREP_PWR_IN signal. This peak positive amplitude voltage of the PREP_PWR_IN signal passes through a unity gain analog amplifier 92 to the positive input of a comparator 94 as well as pin 1 of connector J2B which is coupled to the missile's telemetry unit.

It should be noted that resistor R3 provides a path to ground through which capacitor C2 discharges. The time constant for capacitor C2 and resistor R3 is about one tenth of a second.

The output of amplifier 92 is coupled to the positive input of a comparator 94. Resistors R4 and R5 provide a reference voltage of about 2.5 volts to the negative input of comparator 94. Whenever the signal occurring at the output of amplifier 92 is greater than 2.5 volts, a logic one (five volts) is provided at the output of comparator 94. Similarly, whenever the signal occurring at the output of amplifier 92 is less than 2.5 volts, a logic zero (zero volts) is provided at the output of comparator 94. This logic signal is then supplied to Pin 8 of connector J2B and Pin 14 of connector P254. Pin 14 of connector P254 is connected to the P07 input of microprocessor 31 to provide the logic signal occurring at the output of comparator 94 to the P07 input of microprocessor 31. Pin 8 of connector J2B is connected to the missile's telemetry unit.

Pins 2, 3, 4, 5, 6 and 7 of connector J2B are coupled to the missile's telemetry unit and provide to the missile's telemetry unit the analog signals FILIMENT_PWR_OUT, GYRO_C_OUT, GYRO_A_OUT, GYRO_B_OUT, RESOLVER_EXCIT_OUT and RESOLVER_RTN_OUT. In a like manner, Pins 9, 10, 11, 12, 13 and 14 of connector J2B are coupled to the missile's telemetry unit and provide to the missile's telemetry unit the discrete signals FILIMENT_PWR_DISC, GYRO_C_DISC, GYRO_A_DISC, GYRO_B_DISC, RESOLVER_EXCIT_DISC and RESOLVER_RTN_DISC.

The signals FILIMENT_PWR_IN, GYRO_A_IN, GYRO_B_IN, GYRO_C_IN, RESOLVER_EXCIT_IN, RESOLVER_RTN_IN are condition for compatibility with microprocessor 31 and the missile's telemetry unit in exactly the same manner as the PREP_PWR_IN signal by signal conditioning circuits that are identical to circuit 91 except for the values of resistors R1 and R2. For example, the signal conditioning circuits for the GYRO_A_IN, GYRO_B_IN and GYRO_C_IN signals have 100 Kilo-ohm resistors for resistor R1 and 100 Kilo-ohm resistors for resistor R2. This results in a voltage divider circuit consisting of resistors R1, R2 and R3 which divides the signal by a factor of about three.

Figure 13:
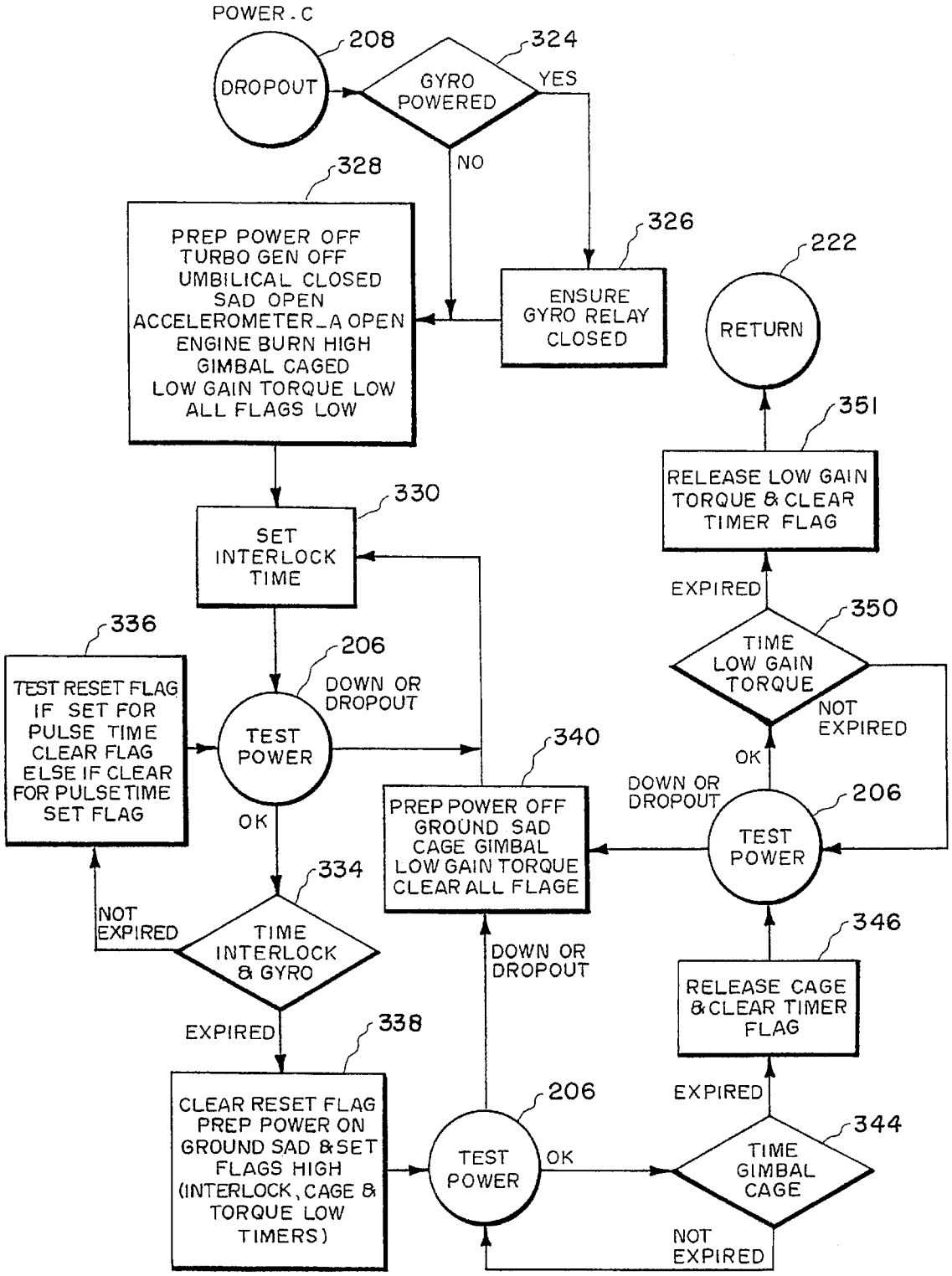
FIG. 13 is a flow chart for the dropout.c module of the program listing of Appendix A.
Figure 14:
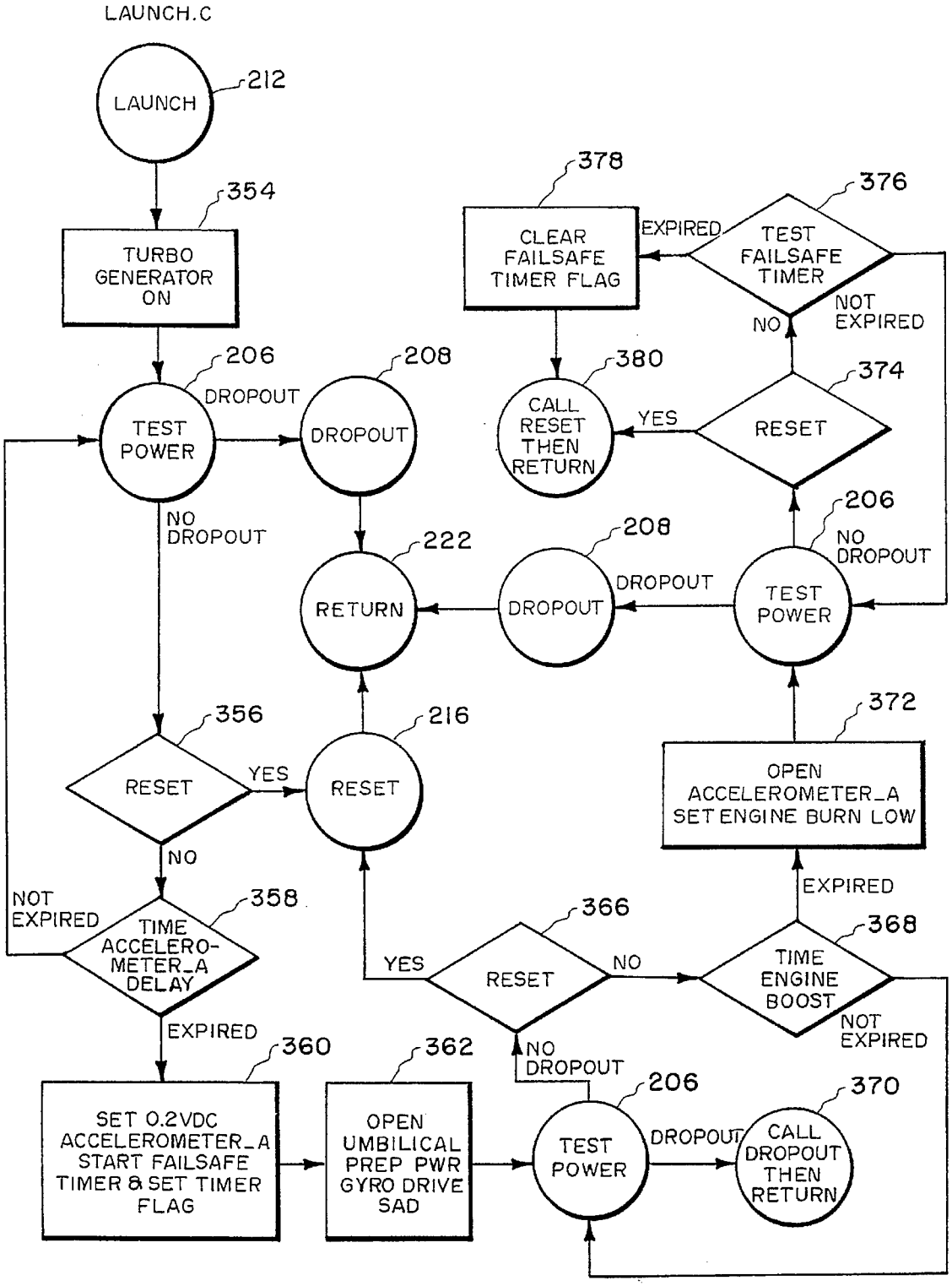
FIG. 14 is a flow chart for the launch routine of the launch.c module of the program listing of Appendix A.
Figure 15:
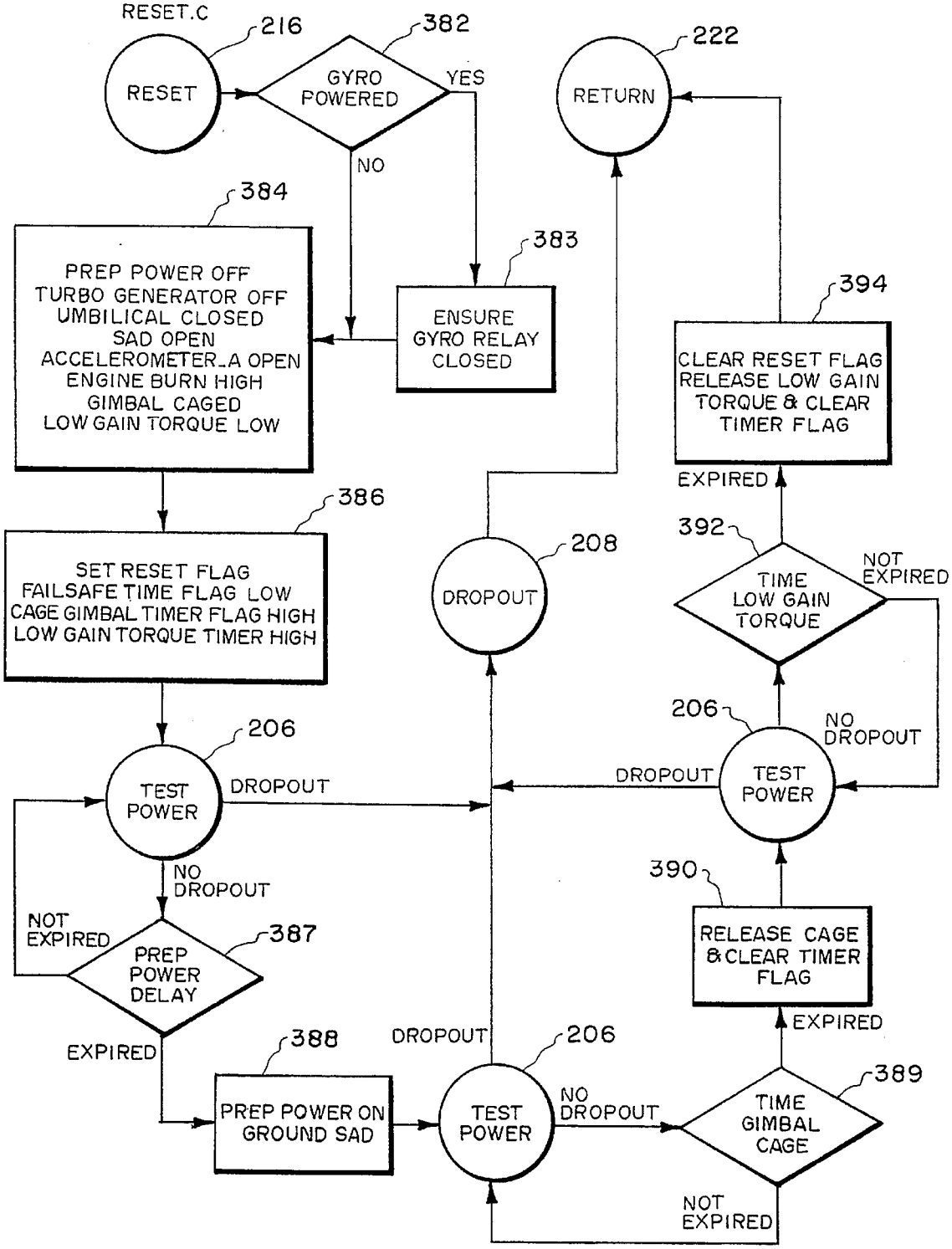
FIG. 15 is a flow chart for the reset routine of the reset.c module of the program listing of Appendix A.

At this time, it should be noted that the RESOLVER_EXCIT_IN and RESOLVER_RTN_IN signals are signals from the launcher and are supplied to microprocessor 31 to monitor the activity of the missile's resolver which missile antenna position information to the aircraft and the missile telemetry unit. When either the RESOLVER_EXCIT_IN signal or the RESOLVER_RTN_IN signal drops out simulator 30 functions as if a power drop out has occurred. The power drop out routine is illustrated in FIG. 13.

Referring to FIGS. 1, 3, 5 and 6, the HIGH_GAIN_IN control signal is from the antenna gimbal drive electronics which drives the position of the missile's antenna. The HIGH_GAIN_IN control signal is supplied through Pin 8 of connector J1 to a signal conditioning circuit 95 which includes a pair of resistors R43 and R55 forming a voltage divider circuit. The HIGH_GAIN_IN signal which is an analog signal having a voltage range from 0–28 volts is first provided to the voltage divider circuit which divides the signal by a factor of five and then provided to the positive input of a comparator 96. The reference voltage provided to the negative input of comparator 96 is about 2.5 volts. Whenever the signal supplied to the positive input of comparator 96 is above 2.5 volts a logic one will appear at the output of comparator 96, otherwise a logic zero is provided at the output of comparator 96. This HIGH_GAIN_IN logic signal which is either a logic one or a logic zero, is supplied to the missile's telemetry unit through Pin 15 of connector J2B. This HIGH_GAIN_IN logic signal is also provided to the P06 input of microprocessor 31 through Pin 35 of connector P254 and is identified as the HIGH_GAIN_MONITIOR signal.

Whenever the HIGH_GAIN_IN signal goes low it indicates that the missile's antenna gimbal was driven into a stop. Microprocessor 31 upon sensing that the HIGH_GAIN_MONITIOR signal is at the logic zero state provides a LO_GAIN_TORQUE signal at its P27 output. This LO_GAIN_TORQUE signal is supplied through line driver 34 to the input of inverter 86. Inverter 86 inverts this signal resulting in a logic zero at its output which energizes the coil of relay 84. This closes the contacts of relay 84 resulting in a logic zero or ground being applied to the signal occurring at the output of the missile's antenna gimbal drive electronics which results in the gimbal being maintained in a low gain state for a predetermined time period. This prevents damage to the antenna gimbal.

Signal conditioning circuit 95 also includes a diode CR8 which protects comparator 96 whenever the voltage level of the HIGH_GAIN_IN signal exceeds 28 volts.

The LAUNCH_IN signal which is a discrete control signal having a voltage of range of 0–28 volts is provided to a signal conditioning circuit 97 which functions in exactly the same manner as the signal conditioning circuit 97. The logic level LAUNCH_IN signal occurring at the output of comparator 98 is supplied to the missile's telemetry unit and the P11 input of microprocessor 31. The LAUNCH_IN signal is a missile launcher generated signal which initiates the launch of the missile.

The NOT_RESET signal is an open contact or a closed contact signal supplied from the aircraft through the missile launcher. The NOT_RESET signal is a control signal which resets missile launch simulator 30 including the relays of simulator 30 to their initial condition. The NOT_RESET signal may be initiated by a switch on the aircraft counsel manually operated by the pilot of the aircraft.

When the contact is open resistor R51 of signal conditioning circuit 99 pulls the positive input of comparator 100 to 15 volts. Since the reference voltage provided to the negative input of comparator 100 is about 2.5 volts a logic one occurs at the output of comparator 100.

When the contact is closed there is a voltage drop of about 15 volts across resistor R51 resulting in a zero volt signal at the positive input of comparator 100 which, in turn, results in a logic zero signal at the output of comparator 100. This logic level zero NOT_RESET signal is supplied to the P10 input of microprocessor 31 via Pin 36 of connector P254.

It should be noted that resistor R57 which is a 100 kilo-ohm resistor, isolates comparator 100 from voltage spikes occurring on the input line to comparator 100. Isolation resistors, each having a value of 100 kilo-ohm are also provided in the input lines to signal conditioning circuits 91, 95, 97 and 99.

Figure 2:
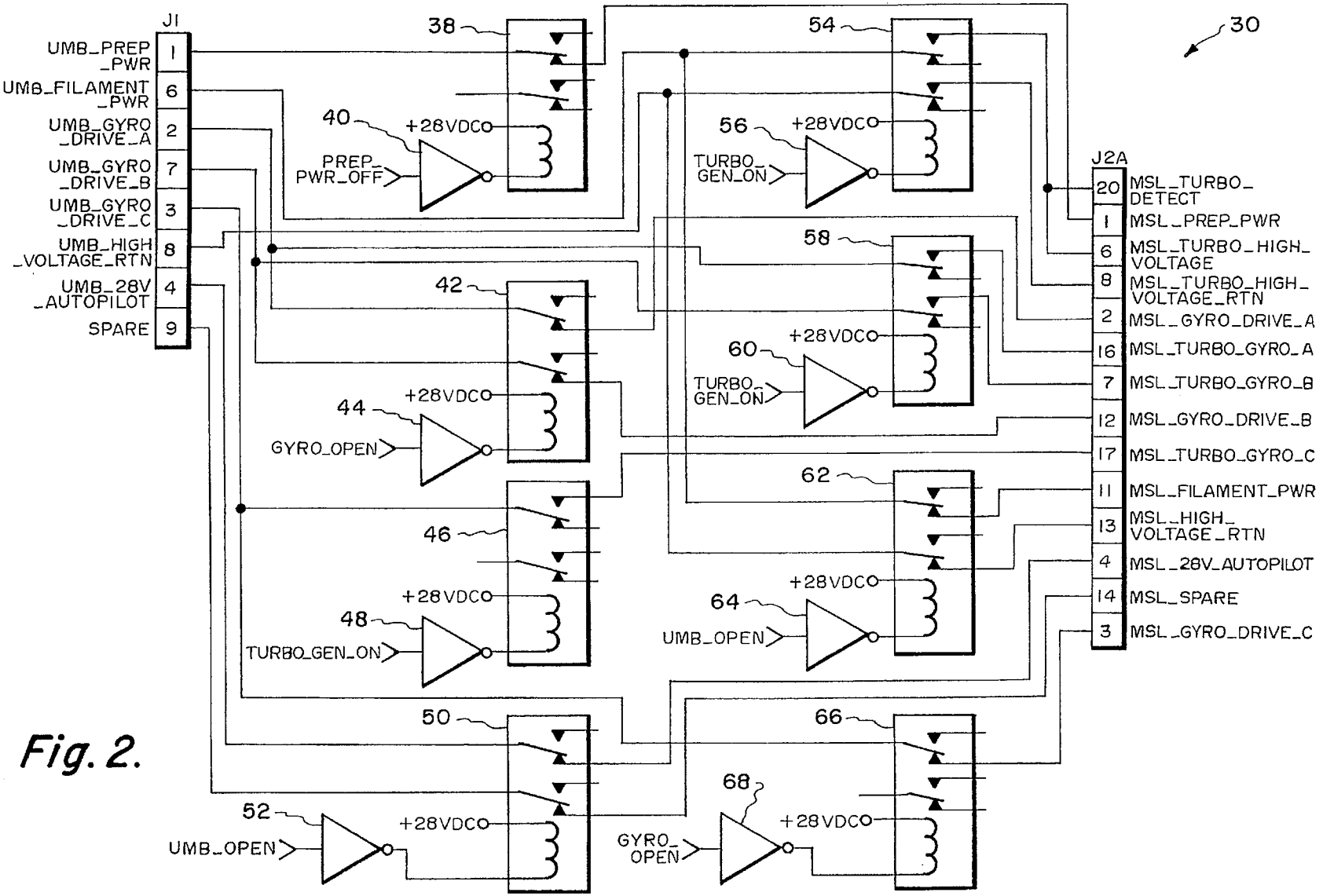
FIG. 2 is a detailed electrical schematic diagram illustrating the main control relays for the missile launch simulator.

Referring first to FIGS. 1, and 2, microprocessor 31 provides at its port two (P20–P27 outputs) the active high logic signals PREP_PWR_OFF, TURBO_GEN_OFF, UMB_OPEN, OPEN_SAD, ENGINE_BOAST, ENGINE_COAST, CAGE_GIM and LO_GAIN_TORQUE. In a like manner, microprocessor 31 provides at its port three (P30–P37 outputs) the active high logic signals INTERLOCK_INDICATE, FAILSAFE_TIMER, GAGE_GIM_TIMER, LO_GAIN_TORQUE, RESET_ACTIVE, SPARE_35, SPARE_36 and GYRO_OPEN. The logic signals occurring at port two of microprocessor 31 are supplied to line driver 34, while the logic signals occurring at port three of microprocessor 31 are supplied to line driver 32.

The active high PREP_PWR_OFF signal from the 1Y1 output of line driver 34 is next supplied to the input of an inverter 40 resulting in a logic zero at the output of inverter 40. When the output of inverter 40 is at the logic zero state, a +28 VDC drop occurs across the coil of a relay 38 energizing the coil of relay 38 which opens a pair of normally closed contacts within relay 38.

At this time, it should be noted that the aircraft's missile launcher provides the following signals through an umbilical cord to the missile: UMB_PREP_PWR, UMB_FILAMENT_PWR, UMB_GYRO_DRIVE_A, UMB_GYRO_DRIVE_B, UMB_GYRO_DRIVE_C and UMB_28V_AUTOPILOT. When the missile separates from the missile launcher and assumes its flight path these signals are no longer provided by the missile launcher via the umbilical cord to the missile.

When the contacts of relay 38 are opened, missile launch simulator 30 disconnects the UMB_PREP_PWR signal from the missile launcher to the missile. The UMB_PREP_PWR signal is the power signal for the missile's on board logic and is supplied to the missile via connector J2A pin 1. The PREP_PWR_OFF signal is provided to inverter 40 only when (1) there is a problem with power which may occur, for example, during the power up sequence (illustrated in FIG. 9) or when a power drop off occurs; and (2) during the launch sequence when the missile is separated from the missile launcher and the missile then assumes its flight path to a target.

Similarly, when the GYRO_OPEN signal is active the contacts of relays 42 and 66 are opened disconnecting the UMB_GYRO_DRIVE_A, UMB_GYRO_DRIVE_B and UMB_GYRO_DRIVE_C signals from the missile launcher to the missile. The UMB_GYRO_DRIVE_A, UMB_GYRO_DRIVE_B and UMB_GYRO_DRIVE_C signals are supplied to the missile via connector J2A pin 2, pin 12 and pin 3 (identified respectively as MSL_GYRO_DRIVE_A, MSL_GYRO_DRIVE_B and MSL_GYRO_DRIVE_B at connector J2A, FIG. 2).

When the missile launch simulator 30 is used to simulate the launch of a missile from an aircraft, the missile's turbo-generator is removed from the missile. The turbo-generator normally supplies power to the missile's gyro once the missile is launched from the aircraft and assumes its flight path. Using missile launch simulator 30 to simulate the launch of a missile requires a substitute source of power for the missile's gyro. This is provided when microprocessor 32 supplies the active high TURBO_GEN_ON signal to the inputs of inverters 48, 56 and 60.

A logic one to the input of inverter 48 energizes the coil of relay 46 closing the contacts of relay 46. Closing the contacts of relay 46 provides a signal path for the UMB_GYRO_DRIVE_C signal through relay 46 resulting in the MSL_TURBO_GYRO_C signal being supplied to the missile's on board gyro. In a like manner, a logic one to the input of inverter 60 energizes the coil of relay 58 closing the contacts of relay 58 which results in the MSL_TURBO_GYRO_A and MSL_TURBO_GYRO_B signals being supplied to the missile's on board gyro.

At this time it should be noted that missile launch simulator 30 uses the launcher generated drive signals for the missile's on board gyro to emulate the function of the missile's on board turbo-generator by activating relays 46, 54 and 58 once the missile launch sequence begins.

A logic one to the input of inverter 56 energizes the coil of relay 54 closing the contacts of relay 54 which results in MSL_TURBO_DETECT and MSL_TURBO_HIGH_VOLTAGE signals being supplied to the missile. This logic one also results in a return path (identified as MSL_TURBO_HIGH_VOLTAGE_RTN) for the MSL_TURBO_HIGH_VOLTAGE signal.

The MSL_TURBO_DETECT signal emulates a signal indicating that the missile turbo generator is providing power to the missile components and is a required signal for the missile launcher to complete the missile launch.

A logic one to the input of inverter 64 energizes the coil of relay 62 opening the contacts of relay 62. This results in the UMB_FILAMENT_PWR signal from the missile launcher to the missile being disconnected. The return path for this signal (identified as MSL_HIGH_VOLTAGE_RTN) is also disconnected by the active high UMB_OPEN signal. It should be noted that UMB_FILAMENT_PWR signal is a power signal from the missile launcher to the missile's on board Klystron.

A logic one to the input of inverter 52 energizes the coil of relay 50 opening the contacts of relay 50. This results in the UMB_28V_AUTOPILOT signal from the missile launcher to the missile being disconnected.

Figure 3:
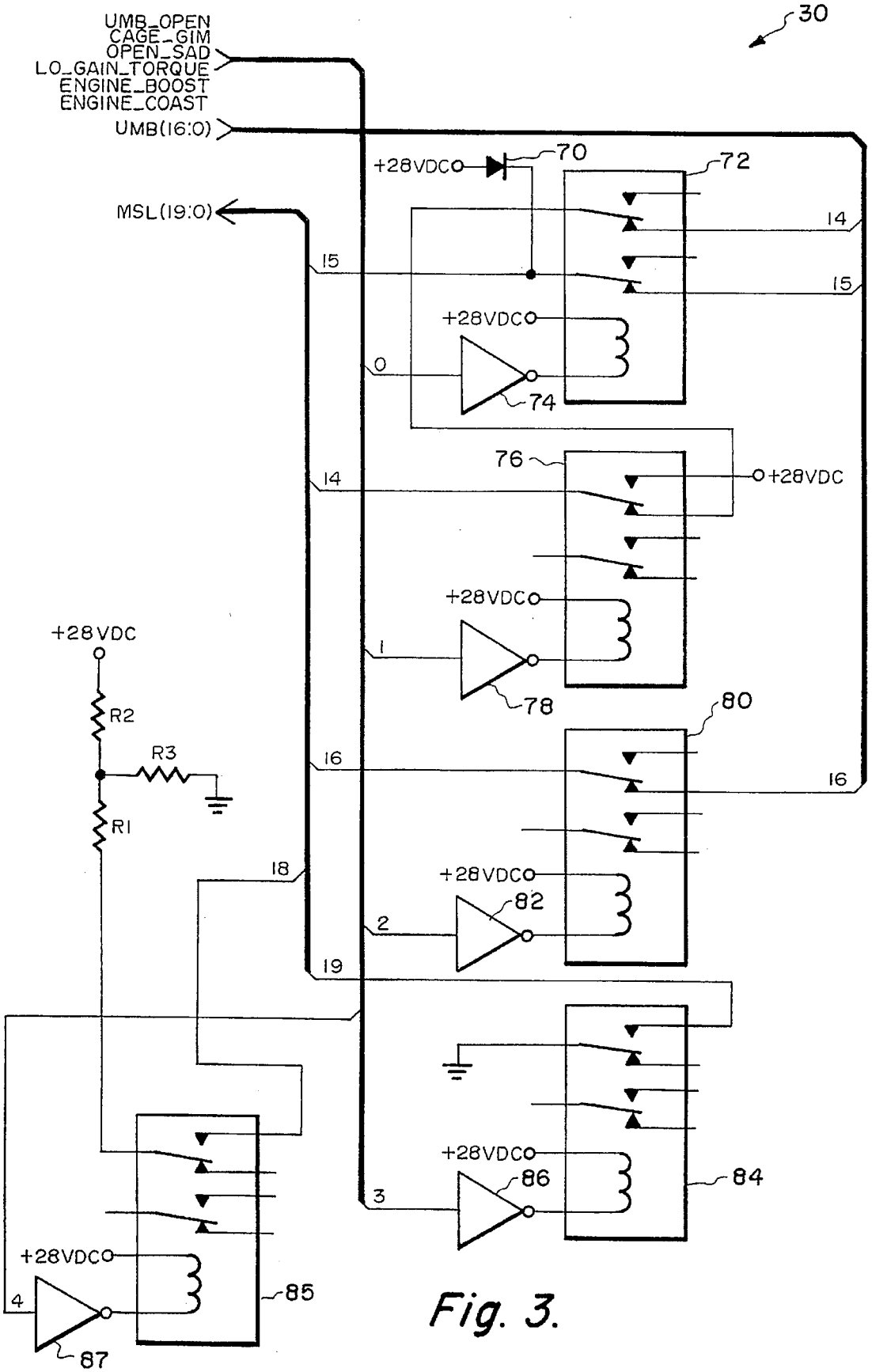
FIG. 3 is a detailed electrical schematic diagram illustrating a portion of a first relay circuit which processes signals from the missile launcher to the missile being tested by the missile launch simulator.

Referring to FIGS. 1, 3 and 6, the active high UMB_OPEN, CAGE_GIMBLE, OPEN_SAD, LO_GAIN_TORQUE, ENGINE_BOAST and ENGINE_COAST signals are supplied from microprocessor 31 via line driver 34 to a first relay board which comprises relays 72, 76, 80, 84 and 85 as well as eight additional relays which are not illustrated but function in exactly the same manner as relays 72, 76, 80, 84 and 85.

Prior to launch the missile launcher provides the +28 VDC signal for caging the missile's gimbal. This signal is supplied through the UMB(16:0) bus and the contacts of relays 72 and 76 to the MSL(19:0) bus.

When the missile is launched the UMB_OPEN signal transitions to a logic one resulting in a logic zero being supplied to the output of inverter 74 which energizes the coil of relay 72 opening the contacts of relay 72. A logic one supplied to the input of inverter 78 is inverted by inverter 78 resulting in a logic zero at its output which energizes the coil of relay 76. This closes the contact of relay 76 which results in +28VDC being provided to the missile's caging electronics to cage the gimbal of the missile.

When the contacts of relay 72 are opened +28VDC is also provided through diode 70 and the MSL(19:0) bus to the missile to enable the gimbal drive electronics in the missile to operate.

A ground signal is provided from the missile to the launcher to indicate to the launcher that the missile is present. This ground signal is supplied from the missile through relay 80 to the missile launcher. When the missile's launch is emulated by simulator 30, the OPEN_SAD signal changes to an active state resulting in a logic one being supplied to the input of inverter 82 which inverts the logic one to a logic zero. This energizes the coil of relay 80 opening the contact of relay 80 resulting in the lose of the ground signal which causes the launcher relays to reset. The coil of relay 80 is also energized by the OPEN_SAD signal whenever a power drop occurs or the NOT_RESET signal is active.

When the ENGINE_BOAST signal is active a logic one is supplied to the input of inverter 87 resulting in a logic zero at its output which energizes the coil of relay 85. This closes the contact of relay 87 providing a bias voltage signal which is supplied to the missile's accelerometer sense lines indicating to the missile that it is accelerating. It should be noted that resistors R1, R2 and R3 each have a value of 10 kilo-ohms although resistors R1, R2 and R3 could have other values depending on the bias voltage required to simulate the acceleration of the missile under test.

The ENGINE_BOAST signal is supplied to a relay configured similar to relay 85 and is the signal which indicates to the missile electronics that the missile's fuel is spent and that it is in a coast mode of operation.

Figure 4:
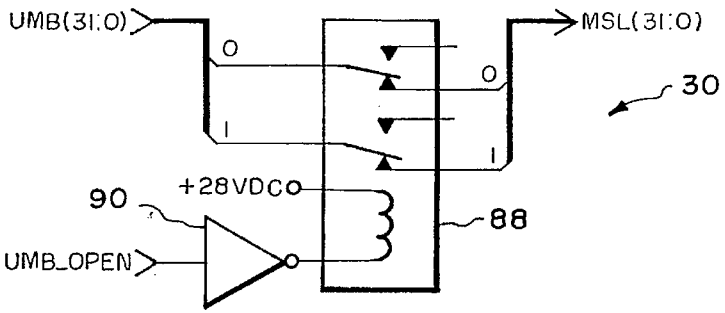
FIG. 4 is a detailed electrical schematic diagram illustrating one of sixteen identical relays of a second relay circuit which processes signals from the missile launcher to the missile being tested by the missile launch simulator.

Referring to FIGS. 1 and 4 there is shown one relay 88 which is representative of each of the sixteen relays on relay board number two and the sixteen relays on relay board number three. Each of the signals passing through the relays of relay boards two and three is provided by the missile launcher through the umbilical cord into the missile electronics. When the active high UMB_OPEN signal is supplied to the input of inverter 90, inverter 90 provides at its output a logic zero energizing the coil of relay 88 opening the contacts of relay 88. This, in turn, emulates the opening of the umbilical cord when the missile is launched from the missile launcher.

Microprocessor 31 also provides to the missile's telemetry unit five discrete signals INTERLOCK_INDICATE, FAILSAFE_TIMER, GAGE_GIM_TIMER, LO_GAIN_TORQUE_TIMER and RESET ACTIVE which are supplied to the missile via pins 17, 18, 19, 20 and 21 of connector J2B (FIG. 5).

Appendix A sets forth a program listing for each the program modules illustrated in FIGS. 7–15. The program listing comprises the following modules EMULATOR.C, INIT_SYS.C, POWER.C, LAUNCH.C, RESET.C and DROPOUT.C (illustrated in FIGS. 7–15) as well as the Register Declarations for microprocessor 31.

It should be noted that the microprocessor used in the preferred embodiment of the present invention is a Model 87C51 CHMOS Single Chip 8-Bit Microcontroller manufactured by Intel Corporation of San Jose, Calif.. The language to program microprocessor 31 is program language C.

Figure 7:
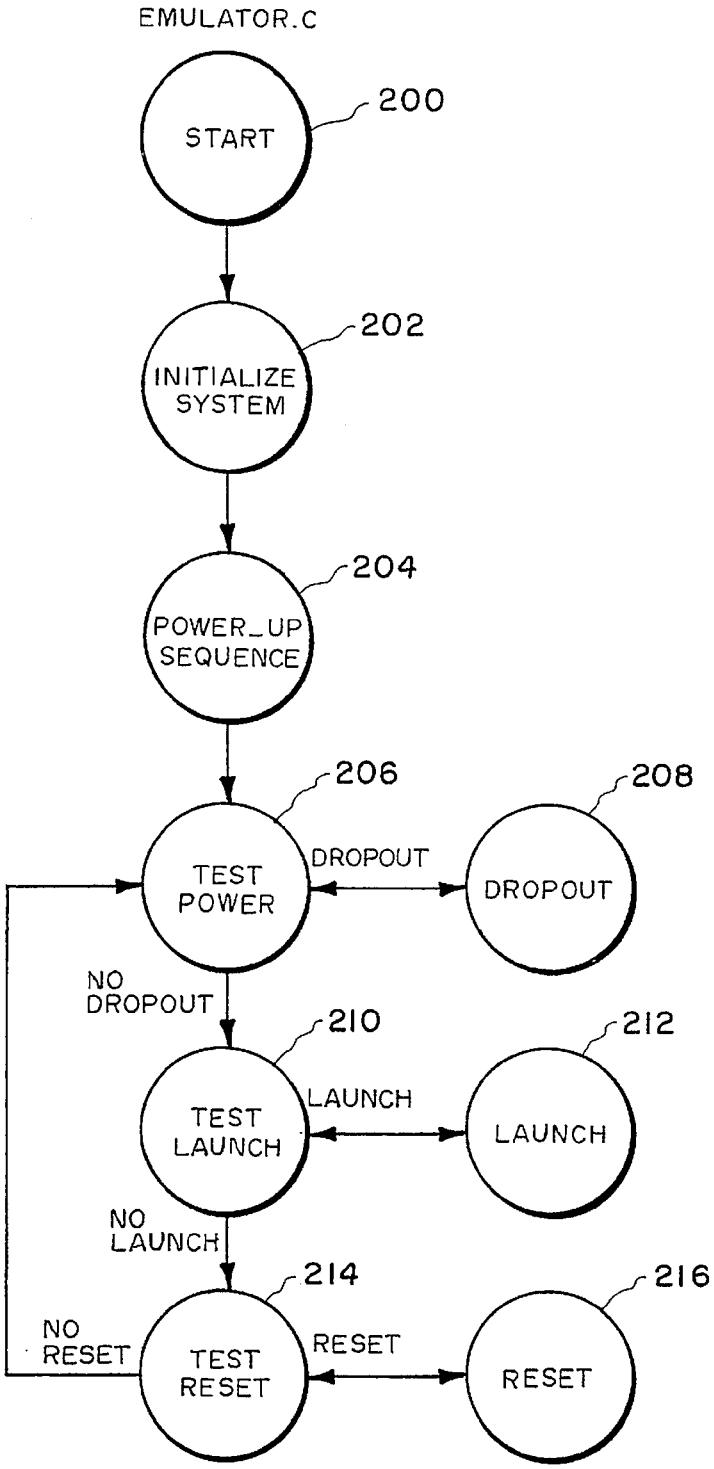
FIG. 7 is a flow chart for the emulator.c module of the program listing of Appendix A.
Figure 8:
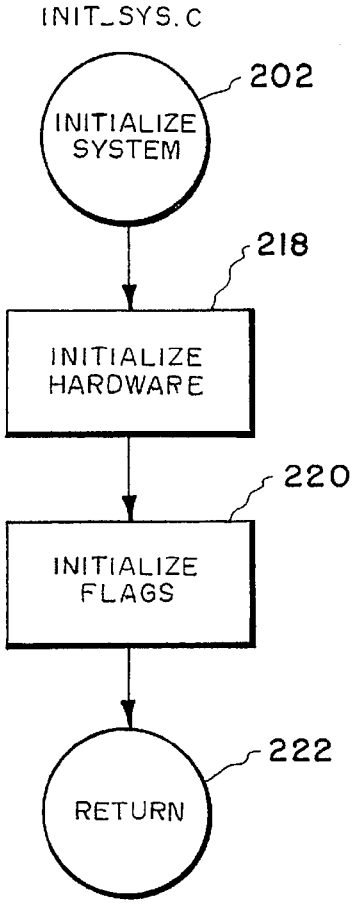
FIG. 8 is a flow chart for the init_sys.c module of the program listing of Appendix A.

Referring to FIGS. 1, 7 and 8, the computer software program of Appendix A first initializes the system (program step 202) following application of power to microprocessor 31. The launch simulator 30 is then initialized with microprocessor 31 setting its internal registers thereby setting the state of all relays within launch simulator 30 to a normally closed state. This, in turn, results in all signal paths from the missile launcher to the missile being closed and each of the relay coils in FIGS. 2, 3 and 4 being de-energized. During program step 220, flags within microprocessor 31 are initialized.

Microprocessor 31 monitors the filament power signal (FILAMENT_PWR), prep power signal (PREP_POWER) and the three phase gyro power signals (GYRO_DRIVE_A, GYRO_DRIVE_B, GYRO_DRIVE_C) looking for a logic ones at its P00, P01, P02, P03 and P07 inputs of microprocessor 31.

At this time it should be noted that filament power and three phase gyro power must be present prior to the application of prep power to the missile, otherwise there may be damage to the missile. Filament power is provided to the missile's Klystron, three phase gyro power spins the gyro in the missile's seeker and prep power powers the missile's electronics.

Referring to FIGS. 1, 2, 7 and 9 the software of Appendix A enters the POWER_UP SEQUENCE (program step 204), followed by a check of the gyro (program step 224). When the gyro is either at a stop condition or is at operating speed then the software of Appendix A proceeds to program step 226. During program step 226, microprocessor 31 checks filament power. If filament power is present, then microprocessor 31 checks gyro drive phase A, gyro drive phase B and gyro drive phase C (program step 230). When the three phases of gyro power are present (logic ones on the GYRO_DRIVE_A, GYRO_DRIVE_B and GYRO_DRIVE_C input lines to microprocessor 31), the software of Appendix A proceeds to program step 236 where microprocessor 31 checks its P37 output to determine the state of the output. When the P37 output of microprocessor 31 is a logic zero, then microprocessor 31 ensures that the missile's gimbal is uncaged by ensuring that its P26 output is a logic zero and that prep power is turned on (program step 240). Microprocessor 31 next sets the INTERLOCK_INDICATE signal to the logic one state (program step 242) and returns to the EMULATOR.C module. The INTERLOCK_INDICATE signal is provided to the missile's telemetry unit for transmission to a ground station.

When the three phases of gyro power are not present, microprocessor 31 outputs a logic zero INTERLOCK_INDICATE signal at its P30 output (program step 228). Microprocessor 31 will next check the PREP_PWR line input to determine if there is a logic one on this line indicating prep power is on (program step 232). If prep power is on then microprocessor 31 will provide a logic one to inverter 40 energizing relay 38 which turns off prep power to the missile (program step 234). This, in turn, is a safeguard in the software of Appendix A to insure that the missile is powered up in the proper sequence. The gyro drive relays are next checked (program step 237) and if the gyro relays are opened the software of Appendix A proceeds to program step 224.

Program step 239 indicates that at least one gyro drive line but not more than two gyro drive lines (GYRO_DRIVE_A, GYRO_DRIVE_B and GYRO_DRIVE_C input lines to microprocessor 31) are at the logic zero state which results in an unbalanced gyro drive. Microprocessor 31 then proceeds to provide a logic one at its P37 output which opens the contacts of relays 42 and 66 disconnecting power to the missile's gyro. The missile's gimbal is also caged during program step 241 and an internal microprocessor gyro drive timer is set for a time period of sixty seconds to allow the gyro to spin down. This timer is also set to sixty seconds following the detection of all gyro drive signals to allow the gyro to spin back up (program step 238).

Referring to FIGS. 1, 2, 7 and 10 the software of Appendix A uses the test power in the power.c module to test the power input lines from the missile launcher to the missile. When filament power is present a logic one is supplied to the P00 input of microprocessor 31. Microprocessor 31 checks its P00 input (program step 248) and whenever there is a logic one at its P00 input proceeds to program step 252 resetting an internal filament power dropout timer (defined as FILAMENT_POWER_LOW_TIME in timer.h module) to one second. Microprocessor 31 next checks its P01 input to determine whether gyro drive phase A power is present (program step 254), followed by a check of its P02 input to determine whether gyro drive phase B power is present (program step 260) and then a check of its P03 input to determine whether gyro drive phase C power is present (program step 264). If gyro drive phase B is present, microprocessor resets the phase B dropout timer within microprocessor 31 (program step 262). If gyro drive phase C is present, microprocessor resets the phase C dropout timer within microprocessor 31 (program step 266).

After microprocessor 31 resets the phase C dropout timer, microprocessor 31 determines whether the gyro drive is balanced by examining the state of the logic signals provided to its P01, P02 and P03 inputs (program step 268). When the P01, P02 and P03 inputs of microprocessor 31 are at the logic one state, microprocessor 31 next determines whether the sixty second gyro drive timer is counting down. If the sixty second gyro drive timer is not counting down then microprocessor determines whether there is gyro power (program step 278) by examining its P37 output. If the P37 output of microprocessor 31 is at the logic zero state, then the software of Appendix A proceeds to emulator.c module (program step 282). If the P37 output of microprocessor 31 is at the logic one state then microprocessor 31 changes the P37 output to a logic zero which de-energizes relays 42 and 66 closing the contacts of relays 42 and 66. This, in turn, results in gyro drive phase A, gyro drive phase B and gyro drive phase C power being supplied to the missile's gyro by the launcher through relays 42 and 66. The internal microprocessor gyro drive timer is also set for a time period of sixty seconds to allow the gyro to spin up.

At this time it should be noted that if, for example, filament power is not present, then there is a test for a dropout condition (program step 250). A dropout condition occurs whenever the one second filament timer has counted down to zero. There is also a status down condition which occurs whenever one second filament timer is still counting down to zero. This status information is also provided by gyro drive phase A, gyro drive phase B and gyro drive phase C power to the emulator.c module before proceeding to the dropout.c function illustrated in FIG. 13.

Figure 11:
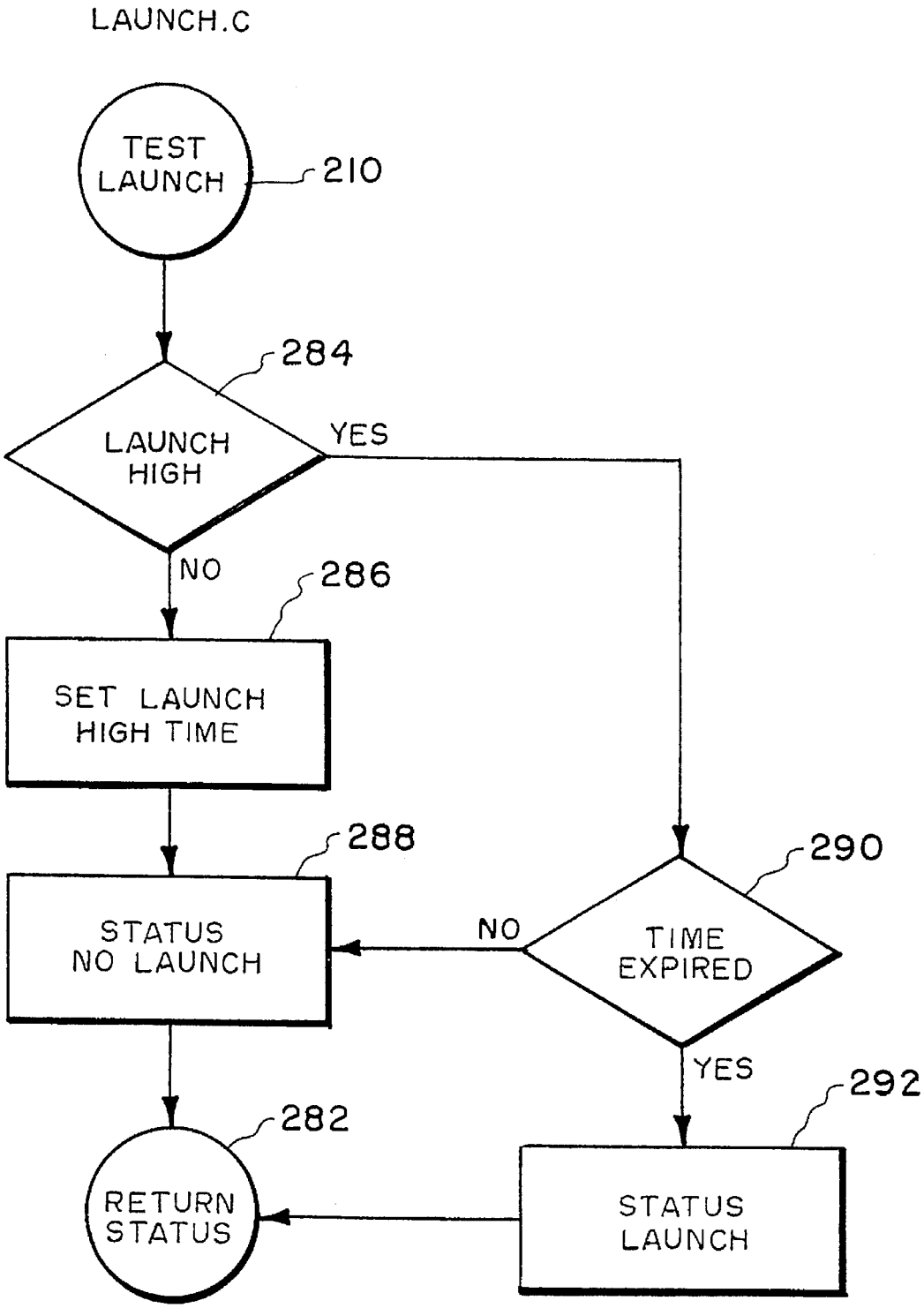
FIG. 11 is a flow chart for the test launch routine of the launch.c module of the program listing of Appendix A.

Referring now to FIGS. 1, 7 and 11, in the test launch function of the launch.c module microprocessor 31 monitors its P11 input looking for a logic one (program step 284). If the launch signal is high for one half second then the software proceeds to program step 292 providing a launch status to the emulator.c module before proceeding to the launch function in the launch.c module illustrated in FIG. 14.

When the P11 input to microprocessor 31 is at the logic zero state, microprocessor 31 sets the a launch high time to one half second (program step 286) before setting the status to no launch (program step 288) and then returning a status of no launch (program step 282). If launch is not high for one half second then the software of Appendix A proceeds from program step 290 to program step 288 returning a no launch status.

When emulating the launch of certain missiles there may be a requirement for a prep power high test after entering the test launch sequence of program step 210. If the prep power signal at the P07 input to microprocessor 31 is not at the logic one state then the program proceeds to program step 286. The software of Appendix A includes this prep power high test even though this is not a requirement for all missiles which missile launch simulator 30 is designed to test.

Referring now to FIGS. 1, 2, 7 and 14, when microprocessor 31 receives a launch status indicating the missile is ready to be launched, the software of Appendix A proceeds to the launch sequence which begins at program step 212. Microprocessor 31 next provides a logic one at its P21 output which energizes relays 46, 54, 58 to emulate the missile turbo generator being turned on (program step 354).

The software of the launch function in the launch.c module next enters a time delay loop to simulate the time required for the missile to accelerate. During this delay power is tested (program step 206) by entering the test power function in the power.c module illustrated in FIG. 10 and the P10 input of microprocessor 31 is monitored (program step 356). This accelerometer delay lasts approximately one half second.

When the accelerometer delay expires, the launch function in the launch.c module proceeds from program step 358 to program step 360. During program step 360 microprocessor 31 provides a logic one at its P24 output which is supplied through line driver 34 to the input inverter 87 resulting in a logic zero at its output. This energizes relay 85 providing a 0.2 VDC bias voltage through the contact of relay 85 to the missile electronics to simulate the acceleration of the missile at launch speed.

A fail safe timer of 150 seconds is also set during program step 360 and a fail safe timer flag is set. When the fail safe timer times out the software of Appendix A will initiate an internal reset allowing for another simulated launch of a missile from an aircraft's launcher.

Microprocessor 31 sets its P20 (PREP_POWER_OFF), P22 (UMB_OPEN), P23 (OPEN_SAD) and P37 (GYRO_OPEN) outputs to a logic one simulating the opening of the umbilical cord which connects the missile launcher to the missile.

It should be noted that the missile's turbo generator may brought on line to supply power to the gyro and the missile electronics (program step 354) prior to the umbilical cord being opened (program step 362) which disconnects power supplied by the launcher to the missile.

The software of the launch function in the launch.c module next enters a loop comprising program steps 206, 366 and 368 which simulates the fuel burn by the missile after the missile leaves the launcher.

When missile burn time of 5.6 seconds expires (program step 368) the software of the launch.c module proceeds to program step 372. During program step 372 microprocessor 31 provides a logic zero at its P24 output to simulate the fuel being burnt by the missile and a logic one at its P25 output to simulate the coasting of the missile after its fuel is spent.

The software of launch.c module next enters a loop (program steps 206, 374 and 376) which monitors the fail. safe timer. When the fail safe timer's time period of 150 seconds expires microprocessor 31 clears the fail safe timer flag (program step 378), initiates an internal reset, and returns to the emulator.c module of FIG. 7.

Figure 12:
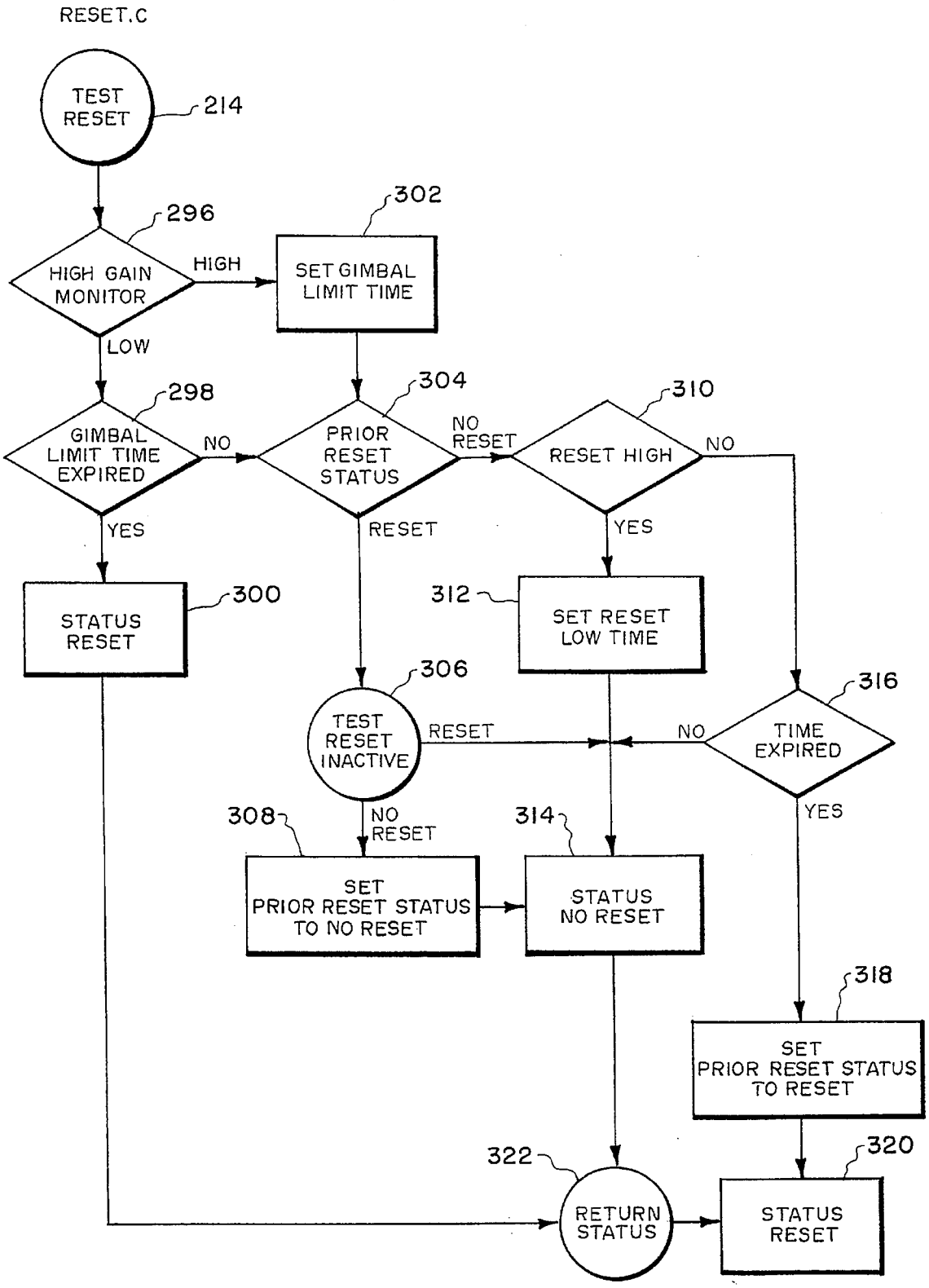
FIG. 12 is a flow chart for the test reset routine of the reset.c module of the program listing of Appendix A.

Referring to FIGS. 1 and 12 after the missile is launched and the launch sequence is completed, the software of Appendix A enters the test reset function in the reset.c module which begins at program step 214. During program step 296, microprocessor 31 examines its P06 input which supplies the HIGH_GAIN_MONITIOR signal to microprocessor 31. When the HIGH_GAIN_MONITIOR signal is at the logic one state the missile is operating correctly. When the HIGH_GAIN_MONITIOR signal is at the logic zero state the gimbal needs to be caged if the gimbal limit time of 30 milliseconds is expired (program step 298). A status reset is then provided (program step 300) indicating that a the software of Appendix A is to enter the reset function in the reset.c module illustrated in FIG. 15 and the missile launch simulator 30 is to be reset.

Referring to FIGS. 1, 2, 3, 7 and 15 the software of Appendix A enters the reset function in the reset.c module whenever the NOT_RESET line to the P10 input of microprocessor 31 or the HIGH_GAIN_MONITOR line to the P06 of microprocessor 31 is at the logic zero state. The software of the reset.c function proceeds to program step 382 to determine whether the missile's gyro is powered. A test is preformed to determine if the missile's gyro is being powered by the missile's turbo generator. If the missile's gyro is being powered by the missile's turbo generator then the software proceeds to program step 383. During program step 383, microprocessor 31 provides a logic zero at its P37 output which is supplied through line driver 32 to inverters 44 and 68 de-energizing relays 42 and 66. De-energizing relays 42 and 66 closes the contacts of relays 42 and 66 which provides gyro drive phase A, gyro drive phase B and gyro drive phase C from the missile launcher to the missile.

If the missile's gyro is not being powered by the missile's turbo generator then the software proceeds directly from program step 382 to program step 384.

During program step 384 the P20 output of microprocessor 31 is set high (PREP_POWER_OFF signal is high). It is required to turn prep power off because filament may not be present. Prep power is again turned on at program step 388 of the reset function.

During program step 384 the turbo generator is turned off by microprocessor 31 (TURBO_GEN_ON signal is low), the umbilical is closed (UMB_OPEN signal is a low) and the SAD is open (OPEN_SAD signal is high). This sets the missile electronics in a safe condition. When the OPEN_SAD signal is high the relays within the launcher reset for a new launch sequence.

Further, during program step 384 accelerometer A is opened so that the missile is not accelerating, engine burn signal within the missile goes high so as to indicate the missile has fuel, the gimbal is caged to protect the gimbal and low gain torque is set low. It should be noted that the ENGINE_BOAST signal and ENGINE_COAST signal provided respectively at the P24 and P25 outputs of microprocessor 31 are at the logic zero state when the engine burn signal is high. It should also be noted that the CAGE_GIM signal from microprocessor 31 and the LO_GAIN_TORQUE signal from microprocessor 31 are each set to the logic one state during program step 384.

The software of the reset.c module next proceeds to program step 386. During program step 386, the reset flag is set indicating a reset is being processed. The fail safe timer flag is set low indicating that there is no longer a launch in progress. The cage gimbal timer flag and the low gain torque timer flags are both set to a logic one. The time required to cage the gimbal is one half second followed by a one half second time period for the low gain torque signal (LO_GAIN_TORQUE) from microprocessor 31 to be at a logic one state.

The software of the reset.c module enters a prep power time delay of one half second (program steps 206 and 387) and then program step 388 during which microprocessor 31 provides a logic zero at its P20 output through line driver 34 to inverter 40 de-energizing relay 38. De-energizing relay 38 closes the contacts of relay 38 which allows the missile launcher to provide prep power to the missile. The SAD is also grounded by de-energizing relay 80.

The software of the reset.c module enters another loop comprising program steps 206 and 389 which is the one half second time period prior to the gimbal being uncaged. During program step 390 the gimbal cage is uncaged and the gimbal timer flag is cleared.

The software of the reset.c module then enters a third loop comprising program steps 206 and 392 which is the one half second time period during which the LO_GAIN_TORQUE signal from microprocessor 31 remains in the logic one state. During program step 394 the reset flag is cleared, the low gain torque timer flag is cleared and the LO_GAIN_TORQUE signal from microprocessor 31 transitions to the logic zero state. The software then returns to the emulator.c module.

Referring to FIGS. 1, 2, 7, and 13 the dropout function in the dropout.c module of the software of Appendix A is almost identical to the reset.c module. The dropout.c module includes an interlock time (program step 330) which is set to thirty seconds. There is also a test for an unbalanced gyro condition (program step 334) in the dropout.c module. The dropout.c module includes a program step 336 during which a pulse having a one half second low time and one half second high time is provided on the RESET_ACTIVE line from microprocessor 31 through line driver 32 to the missile's telemetry unit. This pulse is also provided to the pilot of the aircraft to indicate to the pilot that there is a dropout condition.

Figure 9:
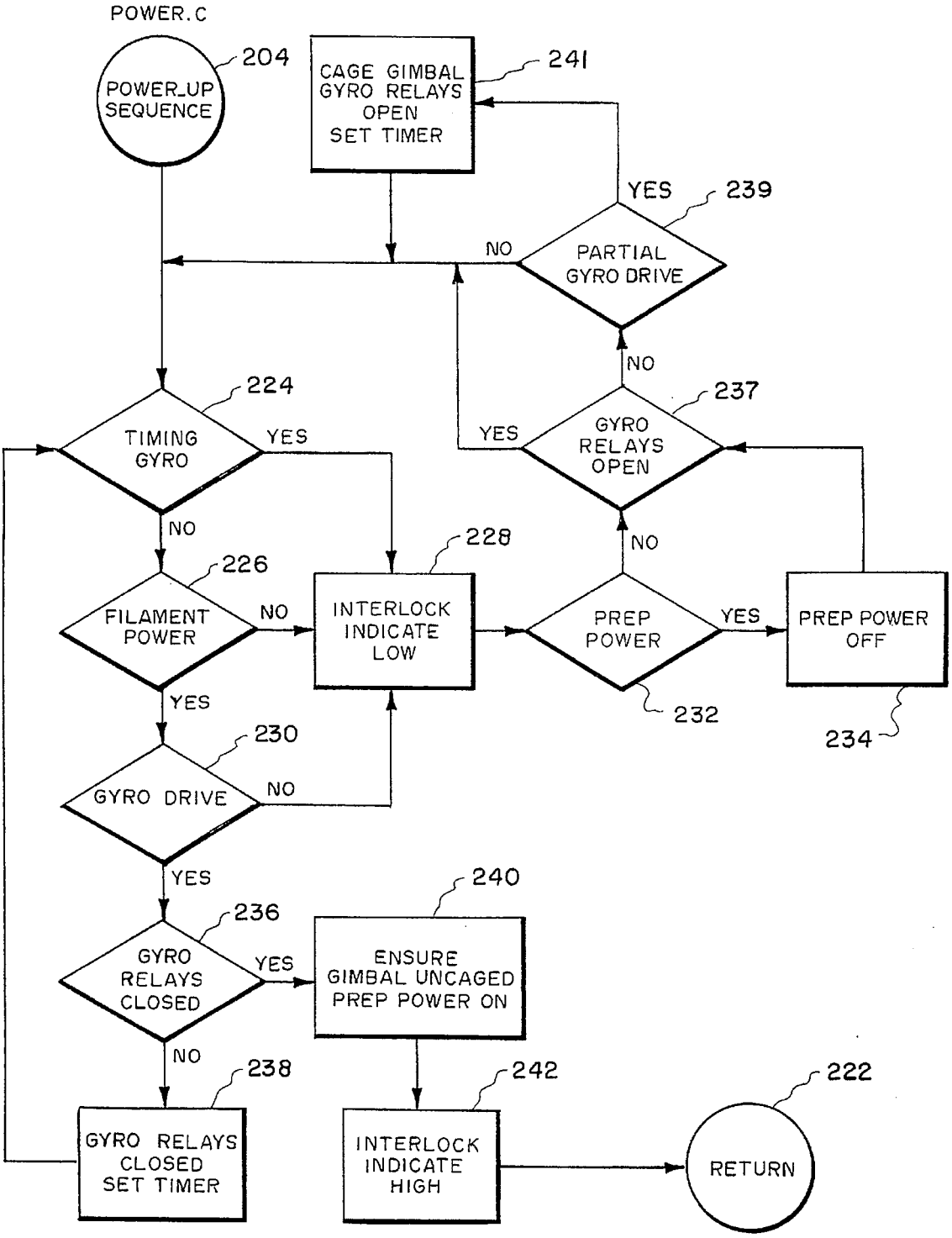
FIG. 9 is a flow chart for power up sequence routine of the power.c module of the program listing of Appendix A.
Figure 10:
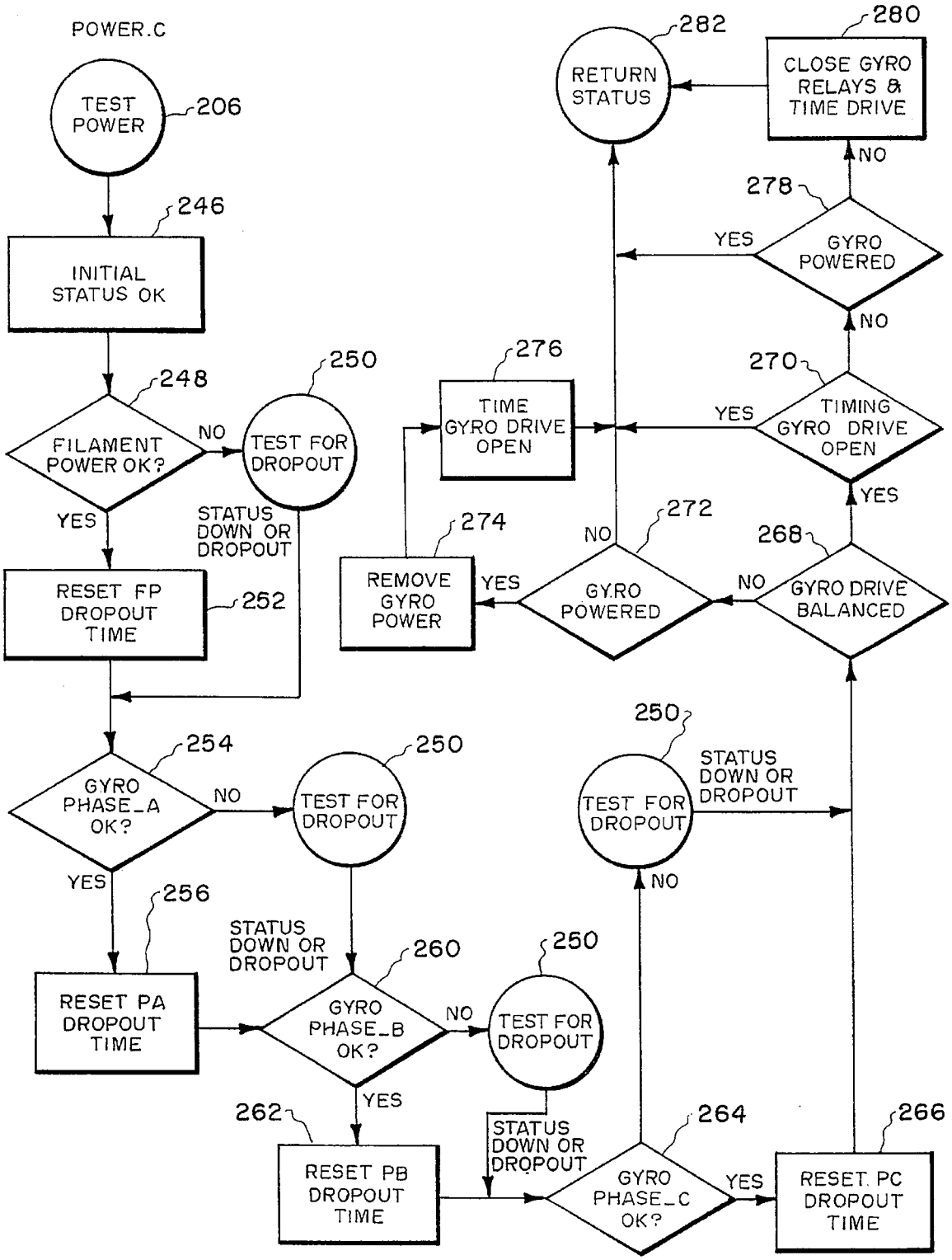
FIG. 10 is a flow chart for the test power routine of the power.c module of the program listing of Appendix A.

Table I illustrates the timing of events that occur during the power-up sequence illustrated in FIG. 9. Table II illustrates the timing of events that occur during the dropout sequence illustrated in FIG. 13. Table III illustrates the timing of events that occur during the reset sequence illustrated in FIG. 15. Table IV illustrates the timing of events that occur during the launch sequence illustrated in FIG. 14.

TABLE I

| | | POWER-UP SEQUENCE | | | | | | |
|---|---|---|---|---|---|---|---|---|
| PORT | FUNCTION | T0 | T1A | T1B | T1C | T1D | T2 | T3 |
| | INPUTS | CONDITION | | | | | | |
| P0.0 | Filament Pwr | OFF | OFF or | ON | ON | ON | ON | ON |
| P0.1 | Gyro Drive A | OFF | OFF or | OFF | OFF or | ON | ON | ON |
| P0.2 | Gyro Drive B | OFF | OFF or | OFF | OFF or | ON | ON | ON |
| P0.3 | Gyro Drive C | OFF | OFF | OFF | OFF | ON | ON | ON |
| P0.4 | Resolver Excit | XXX | XXX | XXX | XXX | XXX | LOW or | HIGH |
| P0.5 | Resolver RTN | XXX | XXX | XXX | XXX | XXX | LOW | HIGH |
| P0.6 | High Gain Monitor | XXX | XXX | XXX | XXX | XXX | XXX | XXX |
| P0.7 | Prep Pwr | OFF | ON | OFF | OFF | OFF | ON | ON |
| P1.0 | Not Reset | XXX | XXX | XXX | XXX | XXX | XXX | HIGH |
| P1.1 | Launch | XXX | XXX | XXX | XXX | XXX | XXX | LOW |
| | OUTPUT | RESPONSE | | | | | | |
| P2.0 | Prep Pwr Off | NO | YES | NO | NO | NO | NO | NO |
| P2.1 | Turbo Gen On | NO | NO | NO | NO | NO | NO | NO |
| P2.2 | UMB Open | NO | NO | NO | NO | NO | NO | NO |
| P2.3 | Open SAD | NO | NO | NO | NO | NO | NO | NO |
| P2.4 | Engine Boost | NO | NO | NO | NO | NO | NO | NO |
| P2.5 | Engine Coast | NO | NO | NO | NO | NO | NO | NO |
| P2.6 | Cage Gim | NO | NO | NO | YES | NO | NO | NO |
| P2.7 | LO Gain Torque | NO | NO | NO | NO | NO | NO | NO |
| P3.0 | Interlock Indicate | NO | NO | NO | NO | YES | YES | YES |
| P3.1 | Failsafe Timer | NO | NO | NO | NO | NO | NO | NO |
| P3.2 | Cage Gim Timer | NO | NO | NO | NO | NO | NO | NO |
| P3.3 | LO Gain Torque Timer | NO | NO | NO | NO | NO | NO | NO |
| P3.4 | Reset Active | NO | NO | NO | NO | NO | NO | NO |
| P3.7 | Gyro Open | NO | NO | NO | YES | NO | NO | NO |

TABLE II

| | | POWER DROP SEQUENCE | | | | | | | |
|---|---|---|---|---|---|---|---|---|---|
| PORT | FUNCTION | T0 | T1A | T1B | T1C | T1D | T1E | T2 | T3 |
| | INPUTS | CONDITION | | | | | | | |
| P0.0 | Filament Pwr | HIGH | LOW | HIGH | HIGH | HIGH | HIGH | HIGH | HIGH |
| P0.1 | Gyro Drive A | HIGH | HIGH | LOW | LOW or | HIGH | HIGH | HIGH | HIGH |
| P0.2 | Gyro Drive B | HIGH | HIGH | LOW | Low or | HIGH | HIGH | HIGH | HIGH |
| P0.3 | Gyro Drive C | HIGH | HIGH | LOW | LOW | HIGH | HIGH | HIGH | HIGH |
| P0.4 | Resolver Excit | HIGH | HIGH | HIGH | HIGH | HIGH | LOW or | HIGH | HIGH |
| P0.5 | Resolver RTN | HIGH | HIGH | HIGH | HIGH | HIGH | LOW | HIGH | HIGH |
| P0.6 | High Gain Monitor | LOW | LOW | LOW | LOW | LOW | LOW | LOW | LOW |
| P0.7 | Prep Pwr | HIGH | HIGH | HIGH | HIGH | LOW | HIGH | HIGH | HIGH |
| P1.0 | Not Reset | HIGH | HIGH | HIGH | HIGH | HIGH | HIGH | HIGH | HIGH |
| P1.1 | Launch | XXX | XXX | XXX | XXX | XXX | XXX | XXX | XXX |
| | OUTPUT | RESPONSE | | | | | | | |
| P2.0 | Prep Pwr Off | NO | YES | YES | YES | NO | YES | NO | NO |
| P2.1 | Turbo Gen On | XXX | NO | NO | NO | XXX | NO | NO | NO |
| P2.2 | UMB Open | XXX | NO | NO | NO | XXX | NO | NO | NO |
| P2.3 | Open SAD | XXX | YES | YES | YES | XXX | YES | NO | NO |
| P2.4 | Engine Boost | XXX | NO | NO | NO | XXX | NO | NO | NO |
| P2.5 | Engine Coast | XXX | NO | NO | NO | XXX | NO | NO | NO |
| P2.6 | Cage Gim | XXX | YES | YES | YES | XXX | YES | YES | NO |
| P2.7 | LO Gain Torque | XXX | YES | YES | YES | XXX | YES | YES | NO+ |
| P3.0 | Interlock Indicate | YES | NO | NO | NO | YES | NO | YES | YES |
| P3.1 | Failsafe Timer | XXX | NO | NO | NO | XXX | NO | NO | NO |
| P3.2 | Cage Gim Timer | XXX | NO | NO | NO | XXX | NO | YES | NO |
| P3.3 | LO Gain Torque Timer | XXX | NO | NO | NO | XXX | NO | YES | NO+ |
| P3.4 | Reset Active | NO | PULSE | PULSE | PULSE | NO | PULSE | NO | NO |
| P3.7 | Gyro Open | NO | NO | NO | YES | NO | NO | NO | NO |

TABLE III

| PORT | FUNCTION | RESET SEQUENCE T0 | T1A | T1B | T2 | T3 | T4 |
|---|---|---|---|---|---|---|---|
| | INPUTS | CONDITION | | | | | |
| P0.0 | Filament Pwr | HIGH | HIGH | HIGH | HIGH | HIGH | HIGH |
| P0.1 | Gyro Drive A | HIGH | HIGH | HIGH | HIGH | HIGH | HIGH |
| P0.2 | Gyro Drive B | HIGH | HIGH | HIGH | HIGH | HIGH | HIGH |
| P0.3 | Gyro Drive C | HIGH | HIGH | HIGH | HIGH | HIGH | HIGH |
| P0.4 | Resolver Excit | HIGH | HIGH | HIGH | HIGH | HIGH | HIGH |
| P0.5 | Resolver RTN | HIGH | HIGH | HIGH | HIGH | HIGH | HIGH |
| P0.6 | High Gain Monitor | LOW | HIGH | LOW | LOW | LOW | LOW |
| P0.7 | Prep Pwr | HIGH | HIGH | HIGH | HIGH | LOW | HIGH |
| P1.0 | Not Reset | HIGH | HIGH | LOW | HIGH | HIGH | HIGH |
| P1.1 | Launch | XXX | XXX | XXX | XXX | XXX | XXX |
| | OUTPUT | RESPONSE | | | | | |
| P2.0 | Prep Pwr Off | NO | YES | YES | NO | NO | NO |
| P2.1 | Turbo Gen On | XXX | NO | NO | NO | NO | NO |
| P2.2 | UMB Open | XXX | NO | NO | NO | NO | NO |
| P2.3 | Open SAD | XXX | YES | YES | NO | NO | NO |
| P2.4 | Engine Boost | XXX | NO | NO | NO | NO | NO |
| P2.5 | Engine Coast | XXX | NO | NO | No | NO | NO |
| P2.6 | Cage Gim | XXX | YES | YES | YES | NO | NO |
| P2.7 | LO Gain Torque | XXX | YES | YES | YES | YES | NO |
| P3.0 | Interlock Indicate | YES | YES | YES | YES | YES | YES |
| P3.1 | Failsafe Timer | XXX | NO | NO | NO | NO | NO |
| P3.2 | Cage Gim Timer | XXX | YES | YES | YES | NO | NO |
| P3.3 | LO Gain Torque Timer | XXX | YES | YES | YES | YES | NO |
| P3.4 | Reset Active | NO | YES | YES | YES | YES | NO |
| P3.7 | Gyro Open | NO | NO | NO | YES | NO | NO |

TABLE IV

| PORT | FUNCTION | LAUNCH SEQUENCE T0 | T1 | T2 | T2+ | T3 | T4 |
|---|---|---|---|---|---|---|---|
| | INPUTS | CONDITION | | | | | |
| P0.0 | Filament Pwr | HIGH | HIGH | HIGH | HIGH | HIGH | HIGH |
| P0.1 | Gyro Drive A | HIGH | HIGH | HIGH | HIGH | HIGH | HIGH |
| P0.2 | Gyro Drive B | HIGH | HIGH | HIGH | HIGH | HIGH | HIGH |
| P0.3 | Gyro Drive C | HIGH | HIGH | HIGH | HIGH | HIGH | HIGH |
| P0.4 | Resolver Excit | HIGH | HIGH | HIGH | HIGH | HIGH | HIGH |
| P0.5 | Resolver RTN | HIGH | HIGH | HIGH | HIGH | HIGH | HIGH |
| P0.6 | High Gain Monitor | LOW | HIGH | LOW | LOW | LOW | LOW |
| P0.7 | Prep Pwr | HIGH | HIGH | HIGH | HIGH | HIGH | HIGH |
| P1.0 | Not Reset | HIGH | HIGH | HIGH | HIGH | HIGH | HIGH |
| P1.1 | Launch | LOW | HIGH | XXX | XXX | XXX | XXX |
| | OUTPUT | RESPONSE | | | | | |
| P2.0 | Prep Pwr Off | NO | NO | NO | YES | YES | YES |
| P2.1 | Turbo Gen On | NO | YES | YES | YES | YES | YES |
| P2.2 | UMB Open | NO | NO | NO | YES | YES | YES |
| P2.3 | Open SAD | NO | NO | NO | YES | YES | YES |
| P2.4 | Engine Boost | NO | NO | YES | YES | NO | NO |
| P2.5 | Engine Coast | NO | NO | NO | NO | YES | YES |
| P2.6 | Cage Gim | NO | NO | NO | NO | NO | NO |
| P2.7 | LO Gain Torque | NO | NO | NO | NO | NO | NO |
| P3.0 | Interlock Indicate | YES | YES | YES | YES | YES | YES |
| P3.1 | Failsafe Timer | NO | NO | YES | YES | YES | NO |
| P3.2 | Cage Gim Timer | NO | NO | NO | NO | NO | NO |
| P3.3 | LO Gain Torque Timer | NO | NO | NO | NO | NO | NO |
| P3.4 | Reset Active | NO | NO | NO | NO | NO | NO |
| P3.7 | Gyro Open | NO | NO | NO | YES | YES | YES |

From the foregoing description, it may readily be seen that the present invention comprises a new unique and exceedingly useful missile launch simulator which constitutes a considerable improvement over the known prior art. Obviously many modifications and variations of the present invention are possible in light of the above teachings. It is therefore to be understood that within the scope of the appended claims, that the invention may be practiced otherwise than as specifically described.

Navy Case No. 77053

Appendix A

```
/*  Register Declarations for 8051 Processor */

/*  BYTE Register  */
sfr P0   = 0x80;
sfr P1   = 0x90;
sfr P2   = 0xA0;
sfr P3   = 0xB0;
sfr PSW  = 0xD0;
sfr ACC  = 0xE0;
sfr B    = 0xF0;
sfr SP   = 0x81;
sfr DPL  = 0x82;
sfr DPH  = 0x83;
sfr PCON = 0x87;
sfr TCON = 0x88;
sfr TMOD = 0x89;
sfr TL0  = 0x8A;
sfr TL1  = 0x8B;
sfr TH0  = 0x8C;
sfr TH1  = 0x8D;
sfr IE   = 0xA8;
sfr IP   = 0xB8;
sfr SCON = 0x98;
sfr SBUF = 0x99;


/*  BIT Register  */
/*  PSW   */
sbit CY   = 0xD7;
sbit AC   = 0xD6;
sbit F0   = 0xD5;
sbit RS1  = 0xD4;
sbit RS0  = 0xD3;
sbit OV   = 0xD2;
sbit P    = 0xD0;

/*  TCON  */
sbit TF1  = 0x8F;
sbit TR1  = 0x8E;
sbit TF0  = 0x8D;
sbit TR0  = 0x8C;
sbit IE1  = 0x8B;
sbit IT1  = 0x8A;
sbit IE0  = 0x89;
sbit IT0  = 0x88;

/*  IE   */
sbit EA   = 0xAF;
sbit ES   = 0xAC;
sbit ET1  = 0xAB;
sbit EX1  = 0xAA;
sbit ET0  = 0xA9;
sbit EX0  = 0xA8;

/*  IP   */
sbit PS   = 0xBC;
```

Navy Case No. 77053

```
sbit PT1  = 0xBB;
sbit PX1  = 0xBA;
sbit PT0  = 0xB9;
sbit PX0  = 0xB8;

/*    Port definitions  */
/*    Port 0      */
      sbit Filament_Power       = 0x80;          /* 115VAC filament power input */
      sbit Gryo_Drive_P1        = 0x81;          /* 36VAC gryo drive phase 1 */
      sbit Gryo_Drive_P2        = 0x82;          /* 36VAC gryo drive phase 2 */
      sbit Gryo_Drive_P3        = 0x83;          /* 36VAC gryo drive phase 3 */
      sbit Resolver_Excit       = 0x84;          /* Resolver excitation */
      sbit Resolver_Rtn  = 0x85;           /* Resolver excitation return */
      sbit High_Gain_Monitor  = 0x86;            /* Monitored for gimbal limit */
      sbit Prep_Power    = 0x87;           /* 115VAC prep power input */

/*    Port 1      */
      sbit Not_Reset            = 0x90;          /* Active low reset signal input */
      sbit Launch        = 0x91;           /* High initiates launch */
      sbit P1_bit2              = 0x92;          /* Spare pin */
      sbit P1_bit3              = 0x93;          /* Spare pin */
      sbit P1_bit4              = 0x94;          /* Spare pin */
      sbit P1_bit5              = 0x95;          /* Spare pin */
      sbit P1_bit6              = 0x96;          /* Spare pin */
      sbit P1_bit7              = 0x97;          /* Spare pin */

/*    Port 2      */
      sbit Prep_Power_Off       = 0xa0;          /* Prep power off signal */
      sbit Turbo_Generator      = 0xa1;          /* Supply turbo generator power */
      sbit Umbilical_Open       = 0xa2;          /* Umbilical separate signal */
      sbit Open_SAD             = 0xa3;          /* Remove ground on SAD */
      sbit Engine_Boost  = 0xa4;           /* Simulated boost signal */
      sbit Engine_Coast  = 0xa5;           /* Simulated coast signal */
      sbit Cage_Gimbal   = 0xa6;           /* Cage gimbal signal */
      sbit Low_Gain_Torque      = 0xa7;          /* Torque motor in low gain */

/*    Port 3      */
      sbit Interlock_Indicate = 0xb0;            /* Power interlock indication */
      sbit Failsafe_Timer       = 0xb1;          /* Failsafe timer flag */
      sbit Cage_Gimbal_Timer  = 0xb2;            /* Cage timer flag */
      sbit Low_Gain_Torque_Timer = 0xb3;         /* Low gain timer flag */
      sbit Reset_Flag    = 0xb4;           /* Spare flag */
      sbit P3_bit5              = 0xb5;          /* Spare flag */
      sbit P3_bit6              = 0xb6;          /* Spare flag */
      sbit Gryo_Drive    = 0xb7;           /* Spare flag */

/* end */
```

Navy Case No. 77053

```
/*****************************************************************************
Include File Name:  emulator.h
Number/Version:
History:
              Date            Rev            Author              Description
              02-May-1994     1.00           C. Houlberg         Baseline

Abstract: emulator.c definitions
*****************************************************************************/
/* Compiler switches */
    #pragma RB(0)            /* use register bank 0 */
    #pragma ROM(compact)     /* short jumps used within functions */
    #pragma SMALL            /* internal memory used by default */
    #pragma SB               /* generate symbols */
    #pragma CODE             /* append asm instructions to listing */
    #pragma NOLC             /* include files will not appear listing file */
    #pragma OE DB            /* object file extensions in obj files for debug */
    #pragma OBJECTEXTEND

/*  Global variables */
    extern unsigned char prior_reset_status;

/*   Constant definitions. */
     #define NO                  0x00
     #define YES                 0x01
     #define OK                  0x00
     #define DOWN                0x01
     #define DROPOUT             0x02
     #define NO_LAUNCH           0x00
     #define LAUNCH              0x01
     #define NO_RESET            0x00
     #define RESET               0x01
     #define OFF                 0x00
     #define ON                  0x01
     #define OPEN                0x01
     #define CLOSED              0x00

     #define Control_Port        P2
     #define SAFE_CONDITION      0xc1   /* Prep_Pwr_Off = YES */
                                        /* Turbo_Gen = OFF */
                                        /* Umbilical_Open = NO */
                                        /* Open_SAD = NO */
                                        /* Engine_Boost = NO */
                                        /* Engine_Coast = NO */
                                        /* Cage_Gimbal = YES */
                                        /* LO_Gain_Torque = YES */

/* end */
```

Navy Case No. 77053

```
/*****************************************************************************
Module Name:    emulator.c
Number/Version:
History:
     Date            Rev            Author                  Description
     02-May-1993     1.00           C. Houlberg             Baseline

Abstract:
    Main (program module to emulate Emulator launch functions).
*****************************************************************************/
/*   All definitions used by main.c are defined in
     the following header files. */
#include "emulator.h"                          /* Global definitions */
#include "timer.h"                             /* Timer definitions */
#include "init_sys.h"                          /* Initialization */
#include "power.h"                             /* Power functions definitions */
#include "launch.h"                            /* Launch function definitions */
#include "reset.h"                             /* Reset function definitions */

/*****************************************************************************
Function Name:    main()
Number/Version:
History:
     Date            Rev            Author                  Description
     02-May-1993     1.00           C. Houlberg             Baseline

Abstract:   Main program module to emulate Emulator launch functions.
     1)  Initialize System (executed upon power up)
     2)   Power Up Sequence (insure power up occurs safely)
     3)   Launch Sequence (manually activated)
     4)   Reset Sequence (manually activated, reset may occur at any time)
     5)   Power Interlock Sequence (power dropout may occur at any time)
*****************************************************************************/
void main(void)
{
     /* Power up initialization */
     initialize_system();                      /* Everything in inactive state */

     /* Validate power up sequence */
     power_up_sequence();

     for(;;)                                   /* Continuous loop */
     {
          if(test_power() == DROPOUT)
            dropout();
          if(test_launch() == LAUNCH)
            launch();
          if(test_reset() == RESET)
            reset();
     }
}

/* end */
```

Navy Case No. 77053

```
/*****************************************************************************
Include File Name:  init_sys.h
Number/Version:
History:
                Date            Rev       Author              Description
                10-Jun-1994     1.00      C. Houlberg         Baseline

Abstract: init_sys.c definitions
*****************************************************************************/
/* Constants
*/
    #define ALL_PCON_OFF            0x00
    #define INTERRUPTS_DISABLED     0x80
    #define ENABLE_T0_INTERRUPT     0x82
    #define EQUAL_PRIORITIES        0x00
    #define INPUT_PORT              0xff
    #define INITIAL_CONTROLS        0x00
    #define INITIAL_FLAGS           0x60
    #define TIMERS_16_BIT           0x11    /* Ungated timers in mode 1 */
    #define TIMERS_ON               0x50    /* TR1 & TR0 set */

/*   Function definition */
    void initialize_system(void);

/* end */
```

Navy Case No. 77053

```
/*****************************************************************************
Module Name:   init_sys.c
Number/Version:
History:
               Date          Rev       Author              Description
               10-Jun-1994   1.00      C. Houlberg         Baseline

Abstract:
    Initialize System
*****************************************************************************/
/*   All definitions used by init_sys.c are defined in
     the following header files. */
#include "emulator.h"                       /* Global definitions */
#include "timer.h"                          /* Timer definitions */
#include "reg51.h"                          /* Register definitions */
#include "init_sys.h"                       /* Initialization definitions */

/*****************************************************************************
Function Name: initialize_system()
Number/Version:
History:
               Date          Rev       Author              Description
               10-Jun-1994   1.00      C. Houlberg         Baseline

Abstract:
    1) Initialize hardware.
    2) Initialize flags.
    3) Initialize timers.
*****************************************************************************/
void initialize_system(void)
{
    /* Variable declarations */
    int i, *pointer;

    /* Initialize hardware */
    /* Ensable timer 0 carry interrupt */
    PCON = ALL_PCON_OFF;                    /* No idle or power down */
    IE = ENABLE_T0_INTERRUPT;               /* Timer 0 interrupt enabled */
    IP = EQUAL_PRIORITIES;                  /* All interrupts equal */

    /* Set ports to initial value */
    P0 = INPUT_PORT;
    P1 = INPUT_PORT;

    /* Port 2 - Output port */
    P2 = INITIAL_CONTROLS;                  /* Prep_Power_Off = NO */
                                            /* Turbo_Generator = OFF */
                                            /* Umbilical_Open = NO */
                                            /* Open_SAD = NO (grounded) */
                                            /* Engine_Boost = OFF */
                                            /* Engine_Coast = OFF */
                                            /* Cage_Gimbal = NO */
                                            /* Low_Gain_Torque = OFF */
    /* Port 3 - Output port */
    P3 = INITIAL_FLAGS;                     /* Interlock_Indicate = NO */
                                            /* Failsafe_Timer = OFF */
                                            /* Cage_Gimbal_Timer = OFF */
                                            /* Low_Gain_Torque_Timer = OFF */
```

Navy Case No. 77053

```
                                        /* Reset_Active = NO */
                                        /* Gryo_Open = NO */
    /* Initialize timer0 */
    TMOD = TIMERS_16_BIT;               /* 1 usec resolution */
    TL0 = TIMER_RESOLUTION & 0xff;      /* Set signal_timer resolution */
    TH0 = (TIMER_RESOLUTION >> 8) & 0xff;
    TCON = TIMERS_ON;                   /* Turn on timers */

    /* Initialize internal flags */
    prior_reset_status = NO_RESET;      /* Global prior reset status */
}

/* end */
```

Navy Case No. 77053

```
/*****************************************************************************
Include File Name:      power.h
Number/Version:
History:
     Date            Rev             Author                  Description
     09-Jun-1994     1.00            C. Houlberg             Baseline

Abstract:       power.c definitions
*****************************************************************************/
/*  Function definitions */
    void power_up_sequence(void);
    char test_power(void);
    char test_for_dropout(unsigned int time);
    void dropout(void);

/* end */
```

Navy Case No. 77053

```
/*****************************************************************************
Module Name:   power.c
Number/Version:
History:
               Date           Rev       Author              Description
               06-Jun-1993    1.00      C. Houlberg         Baseline

Abstract:
    Power Up Sequence (follows initialization of controller).
    Test Power (power is tested for dropouts that could occur any time).
    Test For Dropout (signal is tested for dropout condition).
    Dropout (recovery from power dropout).
*****************************************************************************/
/*  All definitions used in power.c are defined in
    the following header files. */
#include "emulator.h"                        /* Global definitions */
#include "timer.h"                           /* Timer definitions */
#include "power.h"                           /* Power functions definitions */
#include "reg51.h"                           /* 87C51 register definitions */

/*****************************************************************************
Function Name: power_up_sequence()
Number/Version:
History:
               Date           Rev       Author              Description
               06-Jun-1993    1.00      C. Houlberg         Baseline

Abstract:
        1)  All Umbilical_Open relays in normally closed position.
            Interlock_indicate and all other emulated functions are
            inactive.
        2)  If 115VAC Prep_Power (W2-3) comes up before 115VAC
            Filament_Power (W2-23) and 3 phase Gryo_Drive
            (W2-28,29,30) are applied the Prep_Power relay will be
            switched open.
        3)  115VAC Filament_Power (W2-23) and 3 phase Gryo_Drive
            (W2-28,29,30) are applied.  115VAC Prep_Power relay switches
            to or remains in closed position.  Interlock_Indicate is set
            active.
        4)  If any phase of the 3 phases of Gryo_Drive drops all Gryo_Drive
            relays will be opened.
        5)  3 phase Gryo_Drive drops from 36VAC to 22VAC.
        6)  115VAC Prep_Power (W2-3) is applied and passes to missile.
        7)  Resolver_Excit (W3-34) and Resolver_Rtn (W3-44) power up.
        8)  Now at initial power up state.
*****************************************************************************/
void power_up_sequence(void)
{
    /* Initially not timing gryo relays */
    timer.Gryo_Relay_Timer = 0;

    do
    {
        while(timer.Gryo_Relay_Timer || !Filament_Power
            || !Gryo_Drive_P1 || !Gryo_Drive_P2 || !Gryo_Drive_P3)
        {
            /* No interlock indicate */
            Interlock_Indicate = NO;
```

Navy Case No. 77053

```
            /* Test if Prep Power is up out of sequence */
            if(Prep_Power)
                Prep_Power_Off = YES;   /* Open Prep_Power relay */

            /* Protect Gryo from unballanced drive */
            if((Gryo_Drive == OK)
                && (Gryo_Drive_P1 || Gryo_Drive_P2 || Gryo_Drive_P3)
                && !(Gryo_Drive_P1 & Gryo_Drive_P2 & Gryo_Drive_P3))
            {
                Cage_Gimbal = YES;      /* Cage the gimbal */
                Gryo_Drive = DOWN;      /* Open Gryo_Drive relays */
                timer.Gryo_Relay_Timer = GRYO_RELAY_OPEN_DELAY;
            }
        }

        if(Gryo_Drive == DOWN)
        {
            Gryo_Drive = OK;            /* Close Gryo_Drive relays */
            timer.Gryo_Relay_Timer = GRYO_RELAY_CLOSE_DELAY;
        }
        else
        {
            Cage_Gimbal = NO;           /* Ensure gimbal uncaged */
            Prep_Power_Off = NO;        /* Ensure Prep_Power relay closed */
            Interlock_Indicate = YES;   /* Ensure interlock indicated */
        }

    } while(!Interlock_Indicate
        || !Prep_Power || !Resolver_Excit || !Resolver_Rtn);
}

/*****************************************************************************
Function Name: test_power()
Number/Version:
History:
                Date            Rev     Author          Description
                06-Jun-1993     1.00    C. Houlberg     Baseline

Abstract:
        1)  Initial status is assumed OK.
        2)  If any power signal drops out return DROPOUT status.
        3)  If any power signal is down for less than the dropout time
            return DOWN status; otherwise, return OK status.
*****************************************************************************/
char test_power(void)
{
    char status = OK;
    char phase1_status = OK;
    char phase2_status = OK;
    char phase3_status = OK;

    /* Test Filament_Power */
    if(Filament_Power)
        timer.Filament_Power_Timer = FILAMENT_POWER_LOW_TIME;
    else
        status = test_for_dropout(timer.Filament_Power_Timer);

    /* Test Gryo_Drive_P1 */
```

Navy Case No. 77053

```
if(Gryo_Drive_P1)
    timer.Gryo_Drive_P1_Timer = GRYO_DRIVE_LOW_TIME;
else
    phase1_status = test_for_dropout(timer.Gryo_Drive_P1_Timer);

/* Test Gryo_Drive_P2 */
if(Gryo_Drive_P2)
    timer.Gryo_Drive_P2_Timer = GRYO_DRIVE_LOW_TIME;
else
    phase2_status = test_for_dropout(timer.Gryo_Drive_P2_Timer);

/* Test Gryo_Drive_P3 */
if(Gryo_Drive_P3)
    timer.Gryo_Drive_P3_Timer = GRYO_DRIVE_LOW_TIME;
else
    phase3_status = test_for_dropout(timer.Gryo_Drive_P3_Timer);

/* Test for unbalanced Gryo_Drive */
if(((phase1_status != DROPOUT) || (phase2_status != DROPOUT)
    || (phase3_status != DROPOUT))
    && ((phase1_status == DROPOUT) || (phase2_status == DROPOUT)
    || (phase3_status == DROPOUT)))
{
    if((Turbo_Generator == ON) || (Gryo_Drive == OK))   /* Gryo powered */
    {
        /* Remove power from gryo */
        Turbo_Generator = OFF;
        Gryo_Drive = DOWN;
        /* Start Gryo_Drive relays open timer */
        timer.Gryo_Relay_Timer = GRYO_RELAY_OPEN_DELAY;
    }
}
else if(timer.Gryo_Relay_Timer == 0)    /* Not timing Gryo_Drive relays */
{
    if((Turbo_Generator == OFF) && (Gryo_Drive == DOWN))    /* No power */
    {
        Gryo_Drive = OK;        /* Close Gryo_Drive relays */
        /* Start Gryo_Drive relays closed timer */
        timer.Gryo_Relay_Timer = GRYO_RELAY_CLOSE_DELAY;
    }
}

/* Set status to account for Gryo_Drive */
if((phase1_status == DROPOUT) || (phase2_status == DROPOUT)
    || (phase3_status == DROPOUT))
    status = DROPOUT;
else if((status != DROPOUT) && ((phase1_status == DOWN)
    || (phase2_status == DOWN) || (phase3_status == DOWN)))
    status = DOWN;

/* Test Resolver_Excit */
if(status != DROPOUT)
{
    if(Resolver_Excit)
        timer.Resolver_Excit_Timer = RESOLVER_LOW_TIME;
    else
        status = test_for_dropout(timer.Resolver_Excit_Timer);
}
```

Navy Case No. 77053

```
    /* Test Resolver_Rtn */
    if(status != DROPOUT)
    {
        if(Resolver_Rtn)
            timer.Resolver_Rtn_Timer = RESOLVER_LOW_TIME;
        else
            status = test_for_dropout(timer.Resolver_Rtn_Timer);
    }

    return status;
}
/*****************************************************************************
Function Name: test_for_dropout()
Number/Version:
History:
                Date            Rev       Author              Description
                06-Jun-1993     1.00      C. Houlberg         Baseline

Abstract:
        1)  If signal is down for less than the dropout time return
            DOWN status; otherwise, return DROPOUT status.
*****************************************************************************/
char test_for_dropout(unsigned int time)
{
    char status;

     /* Test for dropout (time expired) */
     if(time)                                    /* No drop-out */
        status = DOWN;
    else                                         /* Drop-out */
          status = DROPOUT;

    return status;
}

/*****************************************************************************
Function Name: dropout()
Number/Version:
History:
                Date            Rev       Author              Description
                06-Jun-1993     1.00      C. Houlberg         Baseline

Abstract:
         1)  115VAC Filament_Power (W2-23) drops out or any phase
             of the 3 phase Gryo_Drive (W2-28,29,30) drops out or
             the resolver power drops out.
         2)  Switch on Cage_Gimbal and Low_Gain_Torque relays.
         3)  Switch off 115VAC Prep_Power (W2-3) and Turbo_Generator power
             (W10-3,4,14,21,22,23), open ground on SAD (W30b-19) to clear
             Liftoff (W2-21,35) signal, deactivate Interlock_Indicate, and
             ensure Umbilical_Open relays are in the normally closed position.
         4)  Deactivate Engine_Boost (remove 0.2VDC from Accelerometer_A)
             and Engine_Coast (remove ground from Engine_Burn).
         5)  Pulse Reset_Flag while Interlock_Indicate is OFF.
         6)  115VAC Filament_Power and 3 Phase Gryo_Drive is back up.
         7)  Wait INTERLOCK_TIME then activate Interlock_Indicate, switch
             on 115VAC Prep_Power, and ensure Reset_Flag is OFF.
         8)  Switch off Cage_Gimbal relay CAGE_GIMBAL_TIME after step 6.
```

Navy Case No. 77053

```
        9)  Switch off Low_Gain_Torque relay LOW_GAIN_TORQUE_TIME
            after step 7.
*****************************************************************************/
void dropout(void)
{
    int status;

    /* Ensure Gryo_Drive relays are closed if gryo is powered */
    if((Turbo_Generator == ON) && (Gryo_Drive == DOWN))
    {
        Gryo_Drive = OK;
        timer.Gryo_Relay_Timer = RELAY_SETTLE_TIME;
        while(timer.Gryo_Relay_Timer);
    }

    /* Put system in safe condition */
    Control_Port = SAFE_CONDITION;

    /* Turn off failsafe timer flag */
    Failsafe_Timer = OFF;

    do
    {
        /* Re-establish safe condition */
        Prep_Power_Off = YES;
        Cage_Gimbal = YES;
        Low_Gain_Torque = YES;
        Open_SAD = YES;

        /* Clear Interlock_Indicate, Cage_Gimbal, and Low_Gain_Torque flags */
        Interlock_Indicate = OFF;
        Cage_Gimbal_Timer = OFF;
        Low_Gain_Torque_Timer = OFF;

        /* Set the Interlock time */
        timer.Interlock_Timer = INTERLOCK_TIME;

        /* Initialize the reset timer */
        timer.Reset_Timer = RESET_PULSE_TIME;

        /* Wait for power OK over interlock time and gryo speed OK */
        while(timer.Interlock_Timer
            || timer.Gryo_Relay_Timer || (Gryo_Drive == DOWN))
        {
            status = test_power();
            if(status != OK)
                timer.Interlock_Timer = INTERLOCK_TIME;

            /* Pulse Reset light */
            if(!timer.Reset_Timer)
            {
                timer.Reset_Timer = RESET_PULSE_TIME;
                timer.Reset_Timer = RESET_PULSE_TIME;
                if(Reset_Flag == OFF)
                    Reset_Flag = ON;
                else
                    Reset_Flag = OFF;
            }
```

Navy Case No. 77053

```
        }

        /* Connect Prep Power and return ground to SAD to enable launcher */
        Prep_Power_Off = NO;
        Open_SAD = NO;

        /* Ensure Reset light is off */
        Reset_Flag = OFF;

        /* Set Interlock_Indicate, Cage, and Torque timer flags */
        Interlock_Indicate = ON;
        Cage_Gimbal_Timer = ON;
        Low_Gain_Torque_Timer = ON;

        /* Set the Cage_Gimbal time */
        timer.Cage_Gimbal_Timer = CAGE_GIMBAL_TIME;
        /* Wait appropriate time to release Cage_Gimbal */
        while((status == OK) && (timer.Cage_Gimbal_Timer))
            status = test_power();
        /* If status is still OK release Cage_Gimbal and clear flag */
        if(status == OK)
        {
            Cage_Gimbal = NO;
            Cage_Gimbal_Timer = OFF;
        }

        if(status == OK)
        {
            /* Set the Low_Gain_Torque time */
            timer.Low_Gain_Torque_Timer = LOW_GAIN_TORQUE_TIME;
            /* Wait appropriate time to release Cage_Gimbal */
            while((status == OK) && (timer.Low_Gain_Torque_Timer))
                status = test_power();
            /* If status is still OK release Low Gain Torque and clear flag */
            if(status == OK)
            {
                Low_Gain_Torque = NO;
                Low_Gain_Torque_Timer = OFF;
            }
        }

    } while(status != OK);
}

/* end */
```

Navy Case No. 77053

```
/*************************************************************************
Include File Name:  reset.h
Number/Version:
History:
              Date          Rev       Author            Description
              09-Jun-1994   1.00      C. Houlberg       Baseline

Abstract: reset.c definitions
*************************************************************************/
/*   Function definitions */
     char test_reset(void);
     char test_reset_inactive(void);
     void reset(void);

/* end */
```

Navy Case No. 77053

```
/*****************************************************************************
Module Name:   reset.c
Number/Version:
History:
               Date           Rev       Author              Description
               06-Jun-1993    1.00      C. Houlberg         Baseline

Abstract:
        Test Reset (user can activate reset at any time).
        Reset (activated by reset line or failsafe condition).
*****************************************************************************/
/*  All definitions used in reset.c are defined in
    the following header files. */
#include "emulator.h"                        /* Global definitions */
#include "timer.h"                           /* Timer definitions */
#include "power.h"                           /* Power definitions */
#include "reset.h"                           /* Reset function definitions */
#include "reg51.h"                           /* 87C51 register definitions */

    /* Global reset flag */
    unsigned char prior_reset_status;
/*****************************************************************************
Function Name: test_reset()
Number/Version:
History:
               Date           Rev       Author              Description
               06-Jun-1993    1.00      C. Houlberg         Baseline

Abstract:
    1)  Returns reset status when High_Gain_Minotor is high for the
        required time to meet gimbal limit condition.
    2)  Returns reset status when reset line is active for required time.
        Once the required time expires the reset line must be detected
        high to once again recognize an active low reset.
*****************************************************************************/
char test_reset(void)
{
    int status = NO_RESET;

    /* Test High_Gain_Monitor for gimbal limit condition */
    if(High_Gain_Monitor)
    {
        if(!timer.Gimbal_Limit_Timer)
            /* Reset system */
            status = RESET;
    }
    else
    {
        timer.Gimbal_Limit_Timer = GIMBAL_LIMIT_TIME;
    }

    /* Look for a switch reset condition only if prior_reset_status is
        currently inactive (NO_RESET) */
    if((status != RESET) && (prior_reset_status == NO_RESET))
    {
     /* Test reset signal */
        if(Not_Reset)                                   /* Reset not
activated */
```

Navy Case No. 77053

```
        {
            timer.Reset_Timer = RESET_LOW_TIME;     /* Set timer for event */
        }
        else
        {
            /* Time event */
            if(!timer.Reset_Timer)                  /* Reset detected */
            {
                /* Reset system */
                prior_reset_status = RESET;
                status = RESET;
            }
        }
    }
    else    /* Test for inactive reset before recognizing reset again */
    {
        prior_reset_status = test_reset_inactive();
    }

     return status;
}

/*****************************************************************************
Function Name: test_reset_inactive()
Number/Version:
History:
               Date           Rev       Author              Description
               06-Jun-1993    1.00      C. Houlberg         Baseline

Abstract:
    1)  Returns reset status when reset line is inactive for required time.
*****************************************************************************/
char test_reset_inactive(void)
{
    int status = RESET;

    /* Test reset signal */
    if(!Not_Reset)                                  /* Reset active */
    {
        timer.Reset_Timer = RESET_HIGH_TIME;        /* Set timer for event */
    }
    else
    {
        /* Time event */
        if(!timer.Reset_Timer)                        /* Reset detected */
        {
            status = NO_RESET;
        }
    }

     return status;
}

/*****************************************************************************
Function Name: reset()
Number/Version:
History:
               Date           Rev       Author              Description
```

Navy Case No. 77053

```
                06-Jun-1993    1.00      C. Houlberg         Baseline

Abstract:
     1)   Not_Reset line went active low or Failsafe_Timer expired.
     2)   Switch on Cage_Gimbal and Low_Gain_Torque relays.
     3)   Switch off 115VAC Prep_Power (W2-3) and Turbo_Generator power
          (W10-3,4,14,21,22,23), open ground on SAD (W30b-19) to clear
          Liftoff (W2-21,35) signal, and ensure Umbilical_Open relays
          are in the normally closed position.
     4)   Switch on 115VAC Prep_Power after appropriate delay.
     5)   Switch off Cage_Gimbal relay an appropriate delay after step 4.
     6)   Switch off Low_Gain_Torque relay an appropriate delay after step 5.
*****************************************************************************/
void reset(void)
{
    int status;

    /* Turn on the Reset light */
    Reset_Flag = ON;

    /* Ensure Gryo_Drive relays are closed */
    if((Turbo_Generator == ON) && (Gryo_Drive == DOWN))
    {
        Gryo_Drive = OK;
        timer.Gryo_Relay_Timer = RELAY_SETTLE_TIME;
        while((status != DROPOUT) && (timer.Gryo_Relay_Timer))
            status = test_power();
    }

    /* If status is still OK */
    if(status != DROPOUT)
    {
     /* Put system in safe condition */
        Control_Port = SAFE_CONDITION;
        Open_SAD = YES;

        /* Clear Failsafe timer flag */
        Failsafe_Timer = OFF;

        /* Set Cage Gimbal and Low Gain Torque timer flags */
        Cage_Gimbal_Timer = ON;
        Low_Gain_Torque_Timer = ON;
    }

    /* Set Prep Power delay time */
    timer.Prep_Power_Delay_Timer = PREP_POWER_DELAY_TIME;
    /* Wait for delay time as long as no dropout is detected */
    while((status != DROPOUT) && (timer.Prep_Power_Delay_Timer))
        status = test_power();
    /* If status is still OK turn on Prep Power and ground SAD */
    if(status != DROPOUT)
    {
        Prep_Power_Off = NO;
        Open_SAD = NO;

        /* Set the Cage_Gimbal time */
        timer.Cage_Gimbal_Timer = CAGE_GIMBAL_TIME;
        /* Wait appropriate time to release Cage_Gimbal */
```

Navy Case No. 77053

```
        while((status != DROPOUT) && (timer.Cage_Gimbal_Timer))
            status = test_power();
    }

    /* If no power dropout release Cage_Gimbal */
    if(status != DROPOUT)
    {
        Cage_Gimbal = NO;
        Cage_Gimbal_Timer = OFF;

        /* Set the Low_Gain_Torque time */
        timer.Low_Gain_Torque_Timer = LOW_GAIN_TORQUE_TIME;
        /* Wait appropriate time to release Low_Gain_Torque */
        while((status != DROPOUT) && (timer.Low_Gain_Torque_Timer))
            status = test_power();
    }

    /* If no power dropout release Low_Gain_Torque and turn off Reset light */
    if(status != DROPOUT)
    {
        Low_Gain_Torque = NO;
        Low_Gain_Torque_Timer = OFF;
        Reset_Flag = OFF;
    }
    else
    {
        dropout();
    }
}

/* end */
```

Navy Case No. 77053

```
/*****************************************************************************
Include File Name:  launch.h
Number/Version:
History:
              Date          Rev      Author              Description
              09-Jun-1994   1.00     C. Houlberg         Baseline

Abstract: launch.c definitions
*****************************************************************************/
/*   Function definitions */
    char test_launch(void);
    void launch(void);

/* end */
```

Navy Case No. 77053

```
/*****************************************************************************
Module Name:   launch.c
Number/Version:
History:
               Date          Rev       Author              Description
               06-Jun-1993   1.00      C. Houlberg         Baseline

Abstract:
    Test Launch (launch is tested when power is OK and reset is inactive).
     Launch Sequence (follows detection of launch signal).
*****************************************************************************/
/*  All definitions used in launch.c are defined in
    the following header files. */
#include "emulator.h"                       /* Global definitions */
#include "timer.h"                          /* Timer definitions */
#include "reset.h"                          /* Reset definitions */
#include "power.h"                          /* Power definitions */
#include "launch.h"                         /* Launch function definitions */
#include "reg51.h"                          /* 87C51 register definitions */

/*****************************************************************************
Function Name: test_launch
Number/Version:
History:
               Date          Rev       Author              Description
               06-Jun-1993   1.00      C. Houlberg         Baseline

Abstract:
     1)   Return LAUNCH status when Launch signal (W2-1) goes
        active high for appropriate time.
*****************************************************************************/
char test_launch(void)
{
    char status = NO_LAUNCH;

     /* Test launch signal */
     if(Launch)                                    /* Launch not active */
     {
          timer.Launch_Timer = LAUNCH_LOW_TIME;     /* Set timer for event */
     }
     else
     {
          /* Time event */
          if(!timer.Launch_Timer)                   /* Valid launch */
          {
               /* Launch is active */
          status = LAUNCH;
          }
     }

    return status;
}

/*****************************************************************************
Function Name: launch
Number/Version:
History:
               Date          Rev       Author              Description
```

Navy Case No. 77053

```
                06-Jun-1993    1.00      C. Houlberg        Baseline

Abstract:
     1)   Launch signal (W2-1) went active high for 0.5 secs.
     2)   Switch on 115VAC High_Voltage_Power (W10-3,4) and 3 phase
          Gryo_Drive (W10-21(Turbo_Voltage-14),22,23) Turbo_Generator power.
     3)   Accelerometer delay after step 2 Start Boost_Timer and
          Failsafe_Timer.  Emulate Engine_Boost by switching
          0.2VDC to Accelerometer_A source (W5-19).
     4)   Switch Umbilical_Open relays to open position.
     5)   Switch open 0.2VDC Engine_Boost signal and ground Engine_Burn
          (W5-53) to emulate Engine_Coast when Boost_Timer expires.
     6)   Invoke reset sequence when Failsafe_Timer expires.
*****************************************************************************/
void launch(void)
{
    int status = OK;

    /* Turn on Turbo Generator power */
    Turbo_Generator = ON;

    /* Set the Accelerometer_A delay time */
    timer.Accelerometer_Delay_Timer = ACCELEROMETER_DELAY_TIME;
    /* Wait for Accelerometer_A delay time while power is OK and no reset */
    while((status != DROPOUT) && (status != RESET)
        && (timer.Accelerometer_Delay_Timer))
    {
        status = test_power();
        if(status != DROPOUT)
            status = test_reset();
    }

    if((status != DROPOUT) && (status != RESET))
    {
        /* Start Engine_Boost and Failsafe timer */
        Engine_Boost = ON;
        timer.Failsafe_Timer = FAILSAFE_TIME;
        Failsafe_Timer = ON;

        /* Open Umbilical (including Prep_Power, Gryo_Drive, and SAD) */
        Umbilical_Open = YES;
        Prep_Power_Off = YES;
        Gryo_Drive = OPEN;
        Open_SAD = YES;

        /* Set Engine_Boost time */
        timer.Boost_Timer = ENGINE_BOOST_TIME;
        /* Wait for Engine Boost time while power is OK and no reset */
        while((status != DROPOUT) && (status != RESET)
            && (timer.Boost_Timer))
        {
            status = test_power();
            if(status != DROPOUT)
                status = test_reset();
        }
    }

    if((status != DROPOUT) && (status != RESET))
```

Navy Case No. 77053

```
    {
        /* Stop Engine_Boost and set Engine Coast low */
        Engine_Boost = OFF;
        Engine_Coast = ON;

        /* Wait for Failsafe time while power is OK and no reset */
        while((status != DROPOUT) && (status != RESET)
            && (timer.Failsafe_Timer))
        {
            status = test_power();
            if(status != DROPOUT)
                status = test_reset();
        }
    }

    /* Check if dropout or reset occurred */
    if(status == DROPOUT)
        dropout();                  /* A dropout occurred */
    else
        reset();                    /* Either reset or failsafe occurred */
}

/* end */
```

Navy Case No. 77053

```
/*****************************************************************************
Include File Name:  timer.h
Number/Version:
History:
                Date            Rev       Author              Description
                02-May-1994     1.00      C. Houlberg         Baseline

Abstract: timer.c definitions
*****************************************************************************/
/*   Constant definitions. */
    /* The Time_Remaining is limited to a 16 bit integer to save space
       in RAM.  The lease significant bit represents a count of Timer
       interrupts generated by the Timer carry. */
    /* Timer count will be set to generate a carry interrupt every
       10 msecs.  All Time_Remaining values will be decremented
       following each interrupt until they reach a value of zero.
       This results in a Time_Remanining resolution of 10 msecs.
       and a range of 655,350 msecs. (over 10.9 mins.). */
    #define TIMER_RESOLUTION            -10000      /* 10,000 usecs. */
    #define TIME_50_MSEC                5
    #define TIME_100_MSEC               10
    #define TIME_250_MSEC               25
    #define TIME_500_MSEC               50
    #define TIME_1_SEC                  100
    #define TIME_2_SEC                  200
    #define TIME_5600_MSEC              560
    #define TIME_30_SEC                 3000
    #define TIME_60_SEC                 6000
    #define TIME_150_SEC                15000

    #define RELAY_SETTLE_TIME           TIME_50_MSEC
    #define FILAMENT_POWER_LOW_TIME     TIME_1_SEC
    #define GRYO_DRIVE_LOW_TIME         TIME_100_MSEC
    #define RESOLVER_LOW_TIME           TIME_100_MSEC
    #define GIMBAL_LIMIT_TIME           TIME_2_SEC

    #define RESET_LOW_TIME              TIME_100_MSEC
    #define RESET_HIGH_TIME             TIME_500_MSEC
    #define RESET_PULSE_TIME            TIME_250_MSEC
    #define LAUNCH_LOW_TIME             TIME_500_MSEC

    #define PREP_POWER_DELAY_TIME       TIME_500_MSEC
    #define ACCELEROMETER_DELAY_TIME    TIME_500_MSEC
    #define ENGINE_BOOST_TIME           TIME_5600_MSEC

    #define INTERLOCK_TIME              TIME_30_SEC
    #define FAILSAFE_TIME               TIME_150_SEC
    #define CAGE_GIMBAL_TIME            TIME_500_MSEC
    #define LOW_GAIN_TORQUE_TIME        TIME_500_MSEC
    #define GRYO_RELAY_OPEN_DELAY       TIME_60_SEC
    #define GRYO_RELAY_CLOSE_DELAY      TIME_60_SEC

/* Structure definition. */
struct timer_table
{
     /* Port 0 functions */
     unsigned int Filament_Power_Timer;
     unsigned int Gryo_Drive_P1_Timer;
```

Navy Case No. 77053

```
    unsigned int Gryo_Drive_P2_Timer;
    unsigned int Gryo_Drive_P3_Timer;
    unsigned int Resolver_Excit_Timer;
    unsigned int Resolver_Rtn_Timer;
    unsigned int Gimbal_Limit_Timer;

    /* Port 1 functions */
    unsigned int Reset_Timer;
    unsigned int Launch_Timer;

    /* Port 2 functions */
    unsigned int Prep_Power_Delay_Timer;
    unsigned int Accelerometer_Delay_Timer;
    unsigned int Boost_Timer;

    /* Port 3 functions */
    unsigned int Interlock_Timer;
    unsigned int Failsafe_Timer;
    unsigned int Cage_Gimbal_Timer;
    unsigned int Low_Gain_Torque_Timer;
    unsigned int Gryo_Relay_Timer;
};

/*  Global variables. */
    extern struct timer_table timer;

/*  Function definitions. */
    void timer_isr(void);

/* end */
```

Navy Case No. 77053

```
/*****************************************************************************
Module Name:   timer.c
Number/Version:
History:
               Date           Rev       Author              Description
               02-May-1994    1.00      C. Houlberg         Baseline

Abstract: Timer interrupt service routine.
*****************************************************************************/
/*   All definitions used by timer.c are defined in
     the following header files.
*/
#include "emulator.h"                          /* Global definitions */
#include "timer.h"                             /* Timer definitions */
#include "reg51.h"                             /* 87C51 register definitions */

struct timer_table timer;

/*****************************************************************************
Function Name: timers_isr()
Number/Version:
History:
               Date           Rev       Author              Description
               02-May-1994    1.00      C. Houlberg         Baseline

Abstract:
    1)  Switches to register bank 1.
    2)  Decrements each signal timer count unless it is zero.
    3)  Switches back to previous register bank.
*****************************************************************************/
void timers_isr(void) interrupt 1 using 1
{
    /* Update timer 0 count */
    TL0 = TIMER_RESOLUTION & 0xff;
    TH0 = (TIMER_RESOLUTION >> 8) & 0xff;

    /* Decrement each and every signal timer count if not zero */
    if(timer.Filament_Power_Timer)
        --timer.Filament_Power_Timer;
    if(timer.Gryo_Drive_P1_Timer)
        --timer.Gryo_Drive_P1_Timer;
    if(timer.Gryo_Drive_P2_Timer)
        --timer.Gryo_Drive_P2_Timer;
    if(timer.Gryo_Drive_P3_Timer)
        --timer.Gryo_Drive_P3_Timer;
    if(timer.Gryo_Relay_Timer)
        --timer.Gryo_Relay_Timer;
    if(timer.Resolver_Excit_Timer)
        --timer.Resolver_Excit_Timer;
    if(timer.Resolver_Rtn_Timer)
        --timer.Resolver_Rtn_Timer;
    if(timer.Gimbal_Limit_Timer)
        --timer.Gimbal_Limit_Timer;
    if(timer.Reset_Timer)
        --timer.Reset_Timer;
    if(timer.Launch_Timer)
        --timer.Launch_Timer;
    if(timer.Prep_Power_Delay_Timer)
```

Navy Case No. 77053

```
        --timer.Prep_Power_Delay_Timer;
    if(timer.Accelerometer_Delay_Timer)
        --timer.Accelerometer_Delay_Timer;
    if(timer.Boost_Timer)
        --timer.Boost_Timer;
    if(timer.Interlock_Timer)
        --timer.Interlock_Timer;
    if(timer.Failsafe_Timer)
        --timer.Failsafe_Timer;
    if(timer.Cage_Gimbal_Timer)
        --timer.Cage_Gimbal_Timer;
    if(timer.Low_Gain_Torque_Timer)
        --timer.Low_Gain_Torque_Timer;
}
/* end */
```

What is claimed is:

1. A missile launch simulator for simulating a launch of a missile from an aircraft on board launcher, said missile launch simulator comprising:

a plurality of signal conditioning circuits means for receiving power and control signals from said aircraft on board launcher, said signal conditioning circuits conditioning said power and control signals to provide digital signals indicative of the presence or absence of said power and control signals;

processing means coupled to said plurality of signal conditioning circuit means for receiving and processing said digital signals from said plurality of signal conditioning circuit means;

said processing means, responsive to the processing of said digital signals thereby, generating a plurality of relay energizing logic signals; and a plurality of relay circuits coupled to said processing means, each of said relay circuits receiving one of said relay energizing logic signals and one of said power signals;

each of said relay circuits being energized by an active state of the one of said relay energizing logic signals received thereby;

each of said relay circuits being de-energized by an inactive state of the one of said relay energizing logic signals received thereby;

at least some of said relay circuits being energized during a simulated launch of said missile to allow said power signals to pass through said relay circuits being energized to said missile to provide power to said missile after said simulated launch, the remainder of said relay circuits being de-energized during said simulated launch of said missile.

2. The missile launch simulator of claim 1 further comprising a system clock signal generator for providing a twelve megahertz system clock signal to processing means.

3. The missile launch simulator of claim 1 further comprising at least one line driver connected to said process ing means.

4. The missile launch simulator of claim 1 wherein at least one of said signal conditioning circuits means comprises:

a first capacitor having a first terminal for receiving one of said power and control signals and a second terminal;

a first resistor having a first terminal connected to said second terminal of said first capacitor and a second terminal;

a second resistor having a first terminal connected to the second terminal of said first resistor and a second terminal connected to ground;

a first diode having an anode connected to the second terminal of said first resistor and a cathode;

a second diode having an anode connected to ground and a cathode connected to the second terminal of said first resistor;

a second capacitor having a first terminal connected to the cathode of said first diode and a second terminal connected to ground;

a third resistor having a first terminal connected to the cathode of said first diode and a second terminal connected to ground;

a unity gain analog amplifier having an input connected to the cathode of said first diode and an output; and a comparator having an input connected to the output of said unity gain amplifier and an output connected to said processing means.

5. The missile launch simulator of claim 1 wherein at least one of said signal conditioning circuits means comprises:

a first resistor having a first terminal for receiving one of said power and control signals and a second terminal;

a second resistor having a first terminal connected to the second terminal of said first resistor and a second terminal connected to ground;

a direct current voltage source having an output;

a diode having an anode connected to the second terminal of said first resistor and a cathode connected to the output of said direct current voltage source; and a comparator having an input connected to the second terminal of said first resistor and an output connected to said processing means.

6. The missile launch simulator of claim 1 wherein at least one of said signal conditioning circuits means comprises:

a first resistor having a first terminal for receiving one of said power and control signals and a second terminal;

a second resistor having a first terminal connected to the first terminal of said first resistor and a second terminal;

a direct current voltage source having an output connected to the second terminal of said second resistor; and a comparator having an input connected to the second terminal of said first resistor and an output connected to said processing means.

7. The missile launch simulator of claim 1 wherein each of said relay circuits comprises:

an inverter having an input connected to said processing means and an output; and a relay having a coil and at least one contact, the coil of said relay being connected to the output of said inverter and the at least one contact of said relay receiving the one of said power signals received by said relay circuit.

8. The missile launch simulator of claim 1 wherein said processing means comprises an eight bit microcontroller.

9. A missile launch simulator for simulating a launch of a missile from an aircraft on board launcher, said missile launch simulator comprising:

a plurality of signal conditioning circuits for receiving power and control signals from said aircraft on board launcher, said signal conditioning circuits conditioning said power and control signals to provide digital signals indicative of the presence or absence of said power and control signals;

a microprocessor coupled to said plurality of signal conditioning circuits for receiving and processing said digital signals from said signal conditioning circuits;

said microprocessor, responsive to the processing of said digital signals thereby, generating a plurality of relay energizing logic signals; and a plurality of relay circuits coupled to said microprocessor, each of said relay circuits receiving one of said relay energizing logic signals and one of said power signals;

each of said relay circuits being energized by an active state of the one of said relay energizing logic signals received thereby;

each of said relay circuits being de-energized by an inactive state of the one of said relay energizing logic signals received thereby;

at least some of said relay circuits being energized during a simulated launch of said missile to allow said power signals to pass through said relay circuits being energized to said missile to provide power to said missile after said simulated launch, the remainder of said relay circuits being de-energized during said simulated launch of said missile each of said relay circuits comprising:

an inverter having an input connected to said microprocessor and an output; and a relay having a coil and at least one contact, the coil of said relay being connected to the output of said inverter and the at least one contact of said relay receiving the one of said power signals received by said relay circuit.

10. The missile launch simulator of claim 9 further comprising a system clock signal generator for providing a twelve megahertz system clock signal to processing means.

11. The missile launch simulator of claim 9 further comprising a pair of line drivers connected to said microprocessor.

12. The missile launch simulator of claim 9 wherein at least one of said signal conditioning circuits comprises:

a first capacitor having a first terminal for receiving one of said power and control signals and a second terminal;

a first resistor having a first terminal connected to said second terminal of to said first capacitor and a second terminal;

a second resistor having a first terminal connected to the second terminal of said first resistor and a second terminal connected to ground;

a first diode having an anode connected to the second terminal of said first resistor and a cathode;

a second diode having an anode connected to ground and a cathode connected to the second terminal of said first resistor;

a second capacitor having a first terminal connected to the cathode of said first diode and a second terminal connected to ground;

a third resistor having a first terminal connected to the cathode of said first diode and a second terminal connected to ground;

a unity gain analog amplifier having an input connected to the cathode of said first diode and an output; and a comparator having an input connected to the output of said unity gain amplifier and an output connected to said microprocessor.

13. The missile launch simulator of claim 9 wherein at least one of said signal conditioning circuits comprises:

a first resistor having a first terminal for receiving one of said power and control signals and a second terminal;

a second resistor having a first terminal connected to the second terminal of said first resistor and a second terminal connected to ground;

a direct current voltage source having an output;

a diode having an anode connected to the second terminal of said first resistor and a cathode connected to the output of said direct current voltage source; and a comparator having an input connected to the second terminal of said first resistor and an output connected to said microprocessor.

14. The missile launch simulator of claim 9 wherein at least one of said signal conditioning circuits comprises:

a first resistor having a first terminal for receiving one of said power and control signals and a second terminal;

a second resistor having a first terminal connected to the first terminal of said first resistor and a second terminal;

a direct current voltage source having an output connected to the second terminal of said second resistor; and a comparator having an input connected to the second terminal of said first resistor and an output connected to said microprocessor.

15. A missile launch simulator for simulating a launch of a missile from an aircraft on board launcher, said missile launch simulator comprising:

ten signal conditioning circuits for receiving power and control signals from said aircraft on board launcher, said signal conditioning circuits conditioning said power and control signals to provide digital signals indicative of the presence or absence of said power and control signals;

a microprocessor coupled to said ten signal conditioning circuits for receiving and processing said digital signals from said ten signal conditioning circuits;

said microprocessor, responsive to the processing of said digital signals thereby, generating a plurality of relay energizing logic signals;

eight relay circuits coupled to said microprocessor, each of said eight relay circuits receiving one of said relay energizing logic signals and one of said power signals;

each of said eight relay circuits being energized by an active state of the one of said relay energizing logic signals received thereby;

each of said eight relay circuits being de-energized by an inactive state of the one of said relay energizing logic signals received thereby;

at least some of said eight relay circuits being energized during a simulated launch of said missile to allow said power signals to pass through said relay circuits being energized to said missile to provide power to said missile after said simulated launch, the remainder of said eight relay circuits being de-energized during said simulated launch of said missile;

each of said eight relay circuits comprising:

an inverter having an input connected to said microprocessor and an output; and a relay having a coil and at least one contact, the coil of said relay being connected to the output of said inverter and the at least one contact of said relay receiving the one of said power signals received by said relay circuit; and a ninth relay circuit coupled to said microprocessor for receiving one of said relay energizing logic signals from said microprocessor, said ninth relay circuit, responsive to the one of said relay energizing signals received thereby, generating a bias voltage signal which is supplied to said missile indicating to said missile that said missile is accelerating after said simulated launch of said missile.

16. The missile launch simulator of claim 15 further comprising a system clock signal generator for providing a twelve megahertz system clock signal to processing means.

17. The missile launch simulator of claim 15 further comprising a tenth relay circuit coupled to said microprocessor for receiving two of said relay energizing logic signals from said microprocessor, said tenth relay circuit, responsive to the two of said relay energizing signals received thereby, providing a direct current voltage signal of about twenty eight volts after said simulated launch of said missile.

18. The missile launch simulator of claim 15 wherein at least five of said eight signal conditioning circuits comprise:

a first capacitor having a first terminal for receiving one of said power and control signals and a second terminal;

a first resistor having a first terminal connected to said second terminal of said first capacitor and a second terminal;

a second resistor having a first terminal connected to the second terminal of said first resistor and a second terminal connected to ground;

a first diode having an anode connected to the second terminal of said first resistor and a cathode;

a second diode having an anode connected to ground and a cathode connected to the second terminal of said first resistor;

a second capacitor having a first terminal connected to the cathode of said first diode and a second terminal connected to ground;

a third resistor having a first terminal connected to the cathode of said first diode and a second terminal connected to ground;

a unity gain analog amplifier having an input connected to the cathode of said first diode and an output; and a comparator having an input connected to the output of said unity gain amplifier and an output connected to said microprocessor.

19. The missile launch simulator of claim 15 wherein at least two of said eight signal conditioning circuits comprises:

a first resistor having a first terminal for receiving one of said power and control signals and a second terminal;

a second resistor having a first terminal connected to the second terminal of said first resistor and a second terminal connected to ground;

a direct current voltage source having an output;

a diode having an anode connected to the second terminal of said first resistor and a cathode connected to the output of said direct current voltage source; and a comparator having an input connected to the second terminal of said first resistor and an output connected to said microprocessor.

20. The missile launch simulator of claim 15 wherein one of said eight signal conditioning circuits comprises:

a first resistor having a first terminal for receiving one of said power and control signals and a second terminal;

a second resistor having a first terminal connected to the first terminal of said first resistor and a second terminal;

a direct current voltage source having an output connected to the second terminal of said second resistor; and a comparator having an input connected to the second terminal of said first resistor and an output connected to said microprocessor.

* * * * *